US011607017B2

(12) United States Patent
Peretto

(10) Patent No.: US 11,607,017 B2
(45) Date of Patent: Mar. 21, 2023

(54) FASTENING ELEMENT FOR COSTUME JEWELLERY AND/OR JEWELLERY ITEMS

(71) Applicant: COLPO & ZILIO S.P.A., Torri di Quartesolo (IT)

(72) Inventor: Roberto Peretto, Dueville (IT)

(73) Assignee: COLPO & ZILIO S.P.A., Torri di Quartesolo (IT)

( * ) Notice: Subject to any disclaimer, the term of this patent is extended or adjusted under 35 U.S.C. 154(b) by 110 days.

(21) Appl. No.: 17/220,500

(22) Filed: Apr. 1, 2021

(65) Prior Publication Data

US 2021/0315330 A1 Oct. 14, 2021

(30) Foreign Application Priority Data

Apr. 8, 2020 (IT) ..... 102020000007504

(51) Int. Cl.
*A44C 5/20* (2006.01)

(52) U.S. Cl.
CPC ..... *A44C 5/2033* (2013.01)

(58) Field of Classification Search
CPC ... A44C 5/2033; A44C 5/2052; A44C 5/2061; A44C 5/2066; A44C 5/2076
See application file for complete search history.

(56) References Cited

U.S. PATENT DOCUMENTS 1,431,729 A * 10/1922 Fischer ..... A44C 5/2061 24/635
1,459,673 A * 6/1923 Jabner ..... A44C 5/2052 24/641
2,051,591 A * 8/1936 Brogan ..... A44C 5/2061 63/3.1
2,495,667 A * 1/1950 Vizner ..... A44C 5/2076 24/DIG. 45
3,462,807 A * 8/1969 Marquardt ..... A44C 5/2047 24/616
3,765,064 A * 10/1973 Hoober ..... A44C 5/2052 24/658

(Continued)

FOREIGN PATENT DOCUMENTS

| | | | |
|---|---|---|---|
| FR | 2154823 | A5 | 5/1973 |
| GB | 859166 | A | 1/1961 |
| KR | 20-0183193 | Y1 | 5/2000 |

OTHER PUBLICATIONS

Italian Search Report dated Nov. 24, 2020 issued in corresponding IT 202000007504 application (2 pages).

*Primary Examiner* — Robert Sandy
*Assistant Examiner* — Louis A Mercado
(74) *Attorney, Agent, or Firm* — Millen, White, Zelano & Branigan, P.C.; William Nixon

(57) ABSTRACT

A fastening and/or connection device makes it possible to fasten jewellery and/or costume jewellery items. Each item includes a first free end and a second free end that are joined together. The device includes a first portion to connect to the first free end of the item and a second portion suited to be connected to the second free end of the item. The device includes a main body, first connection means suited to place the main body and the first portion in a disengaged operating configuration or in an engaged operating configuration. A second connection means places the main body and the second portion in a disengaged operating configuration or in an engaged operating configuration.

13 Claims, 16 Drawing Sheets

(56) References Cited

U.S. PATENT DOCUMENTS

| | | | | |
|---|---|---|---|---|
| 10,722,005 | B1 * | 7/2020 | DiPietro | A44C 5/2052 |
| 10,945,494 | B1 * | 3/2021 | Thomsen | A44C 5/2076 |
| 11,140,952 | B2 * | 10/2021 | Oganesian | A44C 5/2033 |
| 2003/0066171 | A1 * | 4/2003 | Terzian | A44C 5/2061 24/647 |
| 2014/0053374 | A1 * | 2/2014 | Jepsen | A44C 5/2076 24/303 |
| 2015/0181987 | A1 * | 7/2015 | Micheli | A44C 5/2033 24/574.1 |
| 2021/0315330 | A1 * | 10/2021 | Peretto | A44C 5/2066 |

* cited by examiner

FASTENING ELEMENT FOR COSTUME JEWELLERY AND/OR JEWELLERY ITEMS

TECHNICAL FIELD OF THE INVENTION

The present invention concerns jewellery and/or costume jewellery items. More specifically, the present invention concerns jewellery and/or costume jewellery items such as, for example, necklaces, chains, bangles, bracelets, charms, pendants and similar items. In greater detail, the present invention concerns a fastening and/or connection device which makes it possible to fasten jewellery and/or costume jewellery items such as, for example, bracelets or chains by connecting the two free ends of said bracelets and/or chains to each other. In even greater detail, the present invention concerns a connection element or system which makes it possible to connect a jewellery and/or costume jewellery item such as, for example, a necklace or a bracelet to a second jewellery and/or costume jewellery item such as, for example, a charm or a pendant.

DESCRIPTION OF THE STATE OF THE ART

It is known that the construction of fastening and/or connection devices for jewellery and/or costume jewellery items has always been a rather difficult task for jewellers. This is due, in particular, to the fact that when making a connection and/or fastening device for jewellery and/or costume jewellery items several needs must be taken in consideration such as, for example, the appearance or external aspect of the connection and/or fastening device, its functionality and its reliability. In fact, a connection and/or fastening device, for example if applied to a bracelet or a chain having a certain value, must guarantee that the two ends of the chain or bracelet, after being connected through the fastening and/or connection device, cannot become disengaged or come off each other accidentally, with the risk of said bracelet or chain being lost. This is particularly important in the case of items made of precious materials, for example made of platinum, gold, silver, brass etc. and/or including precious stones. The same applies to charms or pendants applied to a necklace, chain or bracelet, in fact also in this case it is necessary to avoid any accidental unfastening of the device used to connect the charm or pendant to the chain, necklace or bracelet.

Regarding the aspect and/or the appearance of the connection device, this must have an attractive aspect and/or be customized according to the requests of the person who will wear it.

Jewellers have made several attempts and efforts to develop solutions which could meet the needs described above and thus to provide fastening and/or connection devices which were reliable and had a pleasant aspect and, in particular, which could be such as to match the style of the jewellery items to which they were applied.

The known technical solutions for making said fastening and/or connection devices typically comprise two main portions which are permanently fixed to the opposite free ends, for example, of a chain or bracelet (for example, through welding, by using connection rings, by burying the main parts in the material used for the respective free ends of the item, or through similar solutions), so that the two portions of the fastening and/or connection element, once fixed, cannot be removed from said two ends, which makes it substantially impossible to customize the fastening and/or connection device, unless a technical operation which modifies its structure is performed.

Thus, the main object of the present invention is to solve or at least partially overcome the problems which characterize the solutions known in the art.

More specifically, the object of the present invention is to propose a solution which makes it possible to provide an easily customizable fastening and/or connection device for jewellery and/or costume jewellery items such as, for example, bracelets, chains, pendants or charms.

It is another object of the present invention to propose a solution which makes it possible to provide a fastening and/or connection device for jewellery and/or costume jewellery items such as, for example, bracelets, chains, pendants or charms which can be used in different items from time to time.

DESCRIPTION OF THE PRESENT INVENTION

According to a first embodiment, the subject of the present invention is a fastening and/or connection device for a jewellery and/or costume jewellery item such as, for example, a chain, a bracelet, a charm, a pendant or similar items, said item having a first free end and a second free end to be joined, said device comprising a first portion suited to be connected to said first free end of said item and a second portion suited to be connected to said second free end of said item, wherein said device comprises:

a main body suited to be interposed between said first portion and said second portion;

first connection means suited to place said main body and said first portion in a disengaged operating configuration or in an engaged operating configuration;

second connection means suited to place said main body and said second portion in a disengaged operating configuration or in an engaged operating configuration;

wherein, to join said free ends of said item, said first connection means and said second connection means interact in such a way that said main body and said second portion are placed in said engaged operating configuration through said second connection means only once said main body and said first portion have been placed in said engaged operating configuration through said first connection means;

and wherein, to separate said free ends of said item, said first connection means and said second connection means interact in such a way that said main body and said first portion are placed in said disengaged operating configuration through said first connection means only once said main body and said second portion have been placed in said disengaged operating configuration by said second connection means.

In a preferred embodiment, the main body comprises a first opening suited to receive the first portion and/or a second opening suited to receive the second portion.

Preferably, the first connection means comprise at least one holding seat associated with the first portion and a movable element associated with the main body, said movable element comprising a holding element suited to engage said at least one holding seat of the first portion in the engaged operating configuration.

In a preferred alternative embodiment of the invention, the first connection means comprise at least one holding element associated with the first portion and a movable element associated with the main body, said movable element comprising at least one seat suited to engage the holding element of the first portion in the engaged operating configuration.

According to a preferred embodiment of the invention, the second connection means comprise at least one holding seat associated with the second portion and a movable element associated with the main body, said movable element comprising a holding element suited to engaged said at least one holding seat of the second portion in the engaged operating configuration.

In a preferred alternative embodiment of the invention, the second connection means comprise at least one holding element associated with the second portion and a movable element associated with the main body, said movable element comprising at least one seat suited to engage the holding element of the second portion in the engaged operating configuration.

In a preferred embodiment, the movable element of the first connection means and the second portion comprise respective interference surfaces suited to interfere in such a way that the first connection means are locked when the main body and the second portion are placed in the engaged operating configuration.

Preferably, the first and/or the second connection means comprise elastic means suited to push and/or maintain the movable element towards the engaged operating configuration.

According to a preferred embodiment of the invention, the elastic means comprise at least one helical spring.

In a preferred embodiment, the first connection means comprise a projecting element associated with the main body and a seat associated with the first portion. Preferably, the first connection means comprise bayonet connection means or screw-in connection means.

According to a preferred embodiment of the invention, the device comprises a movable locking element suited to lock the first portion when the main body and the second portion are placed in the engaged operating configuration.

The subject of the present invention includes also a jewellery and/or costume jewellery item such as, for example, a necklace, a bracelet, a pendant, a charm or similar items, said item having a first free end and a second free end suited to be joined by means of a device, wherein said device comprises a fastening and/or connection device as described above.

According to another aspect of the present invention, the same concerns an ornamental jewellery and/or costume jewellery item such as, for example, a necklace, a bracelet, a charm, a pendant or similar items, said ornamental item comprising an item having a first free end and a second free end and said ornamental item comprising a device suited to join said free ends of said item, wherein said device comprises a fastening and/or connection device as described above.

BRIEF DESCRIPTION OF THE DRAWINGS

Further advantages, objectives and characteristics as well as further embodiments of the present invention are defined in the claims and are clarified in the following description, making reference to the attached drawings; in the drawings, corresponding or equivalent characteristics and/or component parts of the present invention are identified by the same reference numbers. More specifically:

Figure 1:
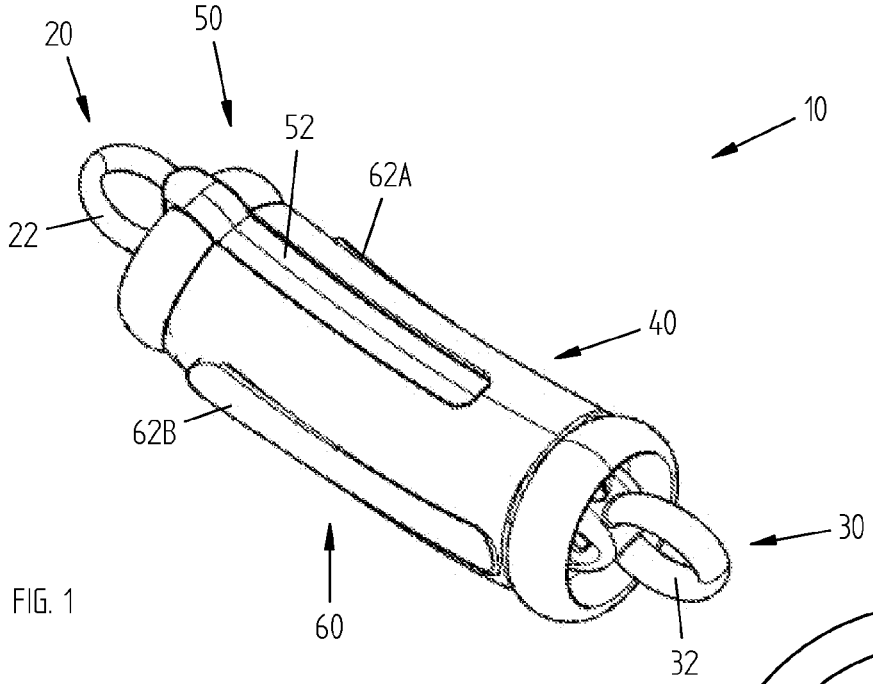
FIG. 1 shows an axonometric view of a fastening and/or connection device according to a preferred embodiment of the invention in the engaged operating configuration.
Figure 6:
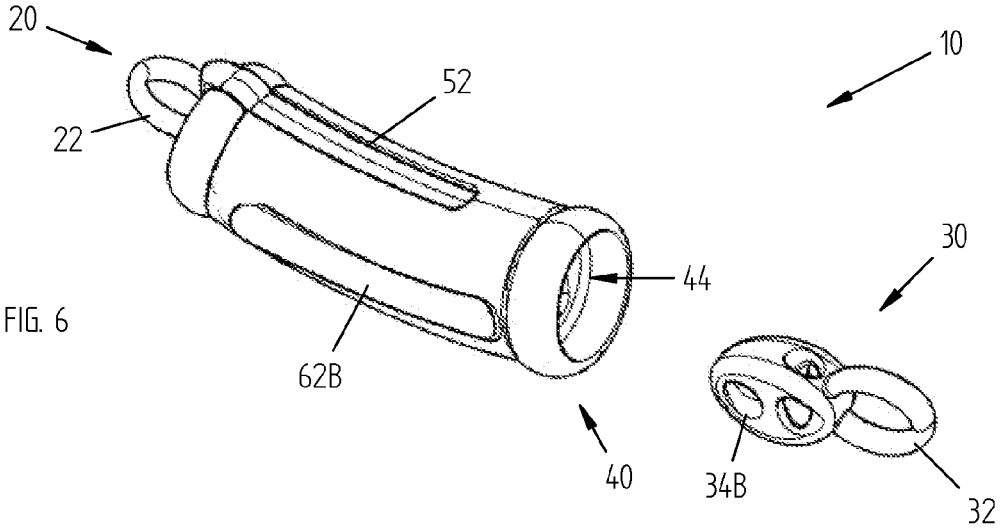
Figure 7:
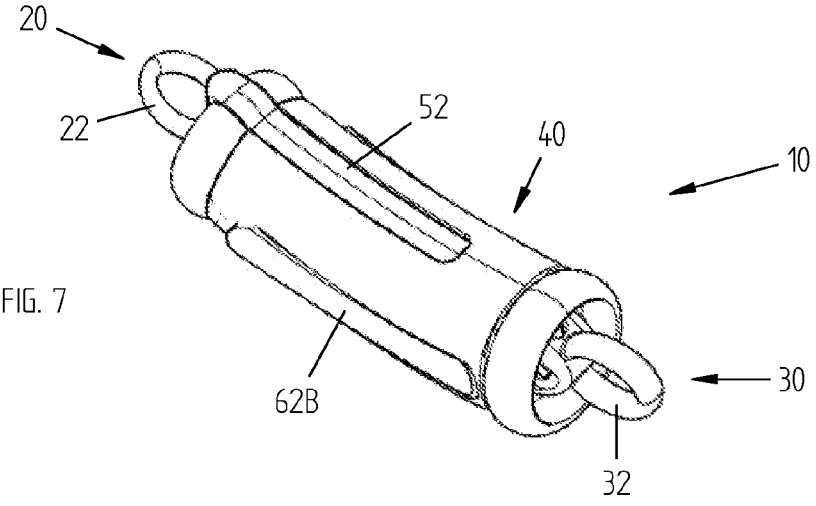
Figure 6A:
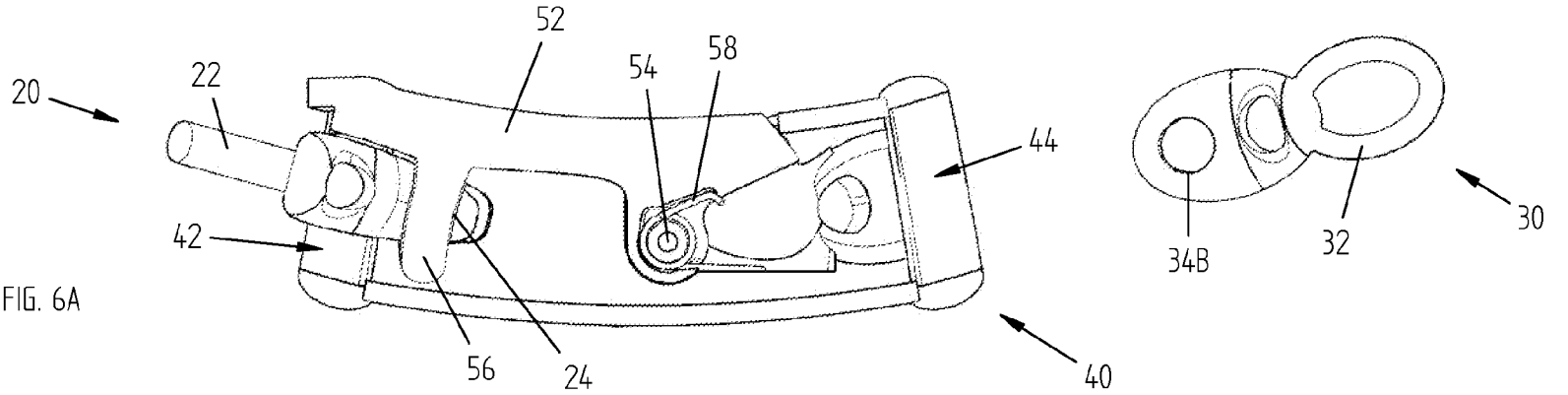
Figure 6B:
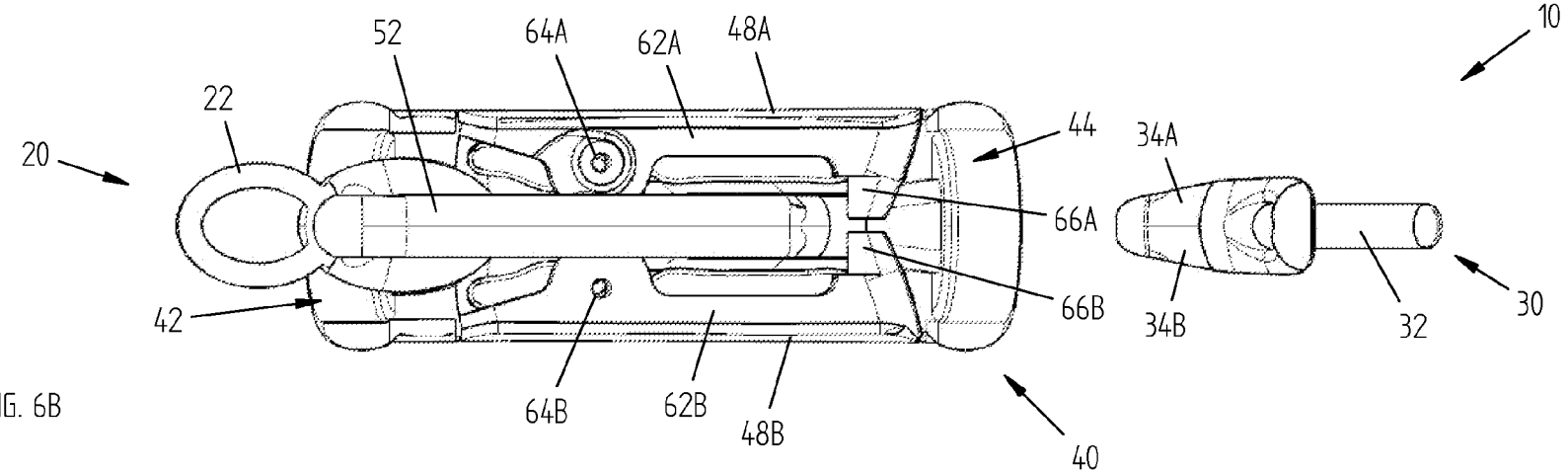
Figure 7A:
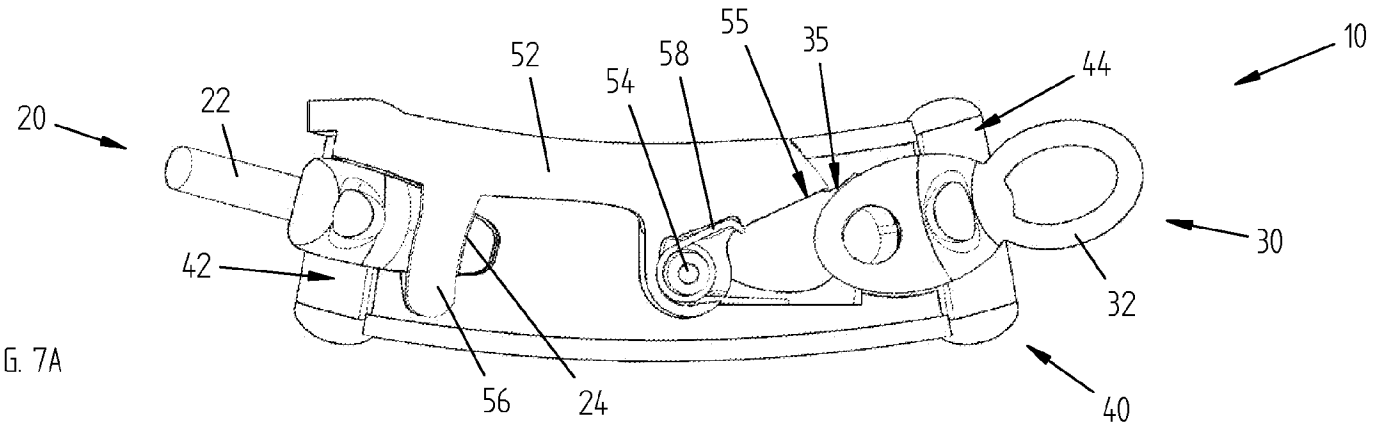
Figure 7B:
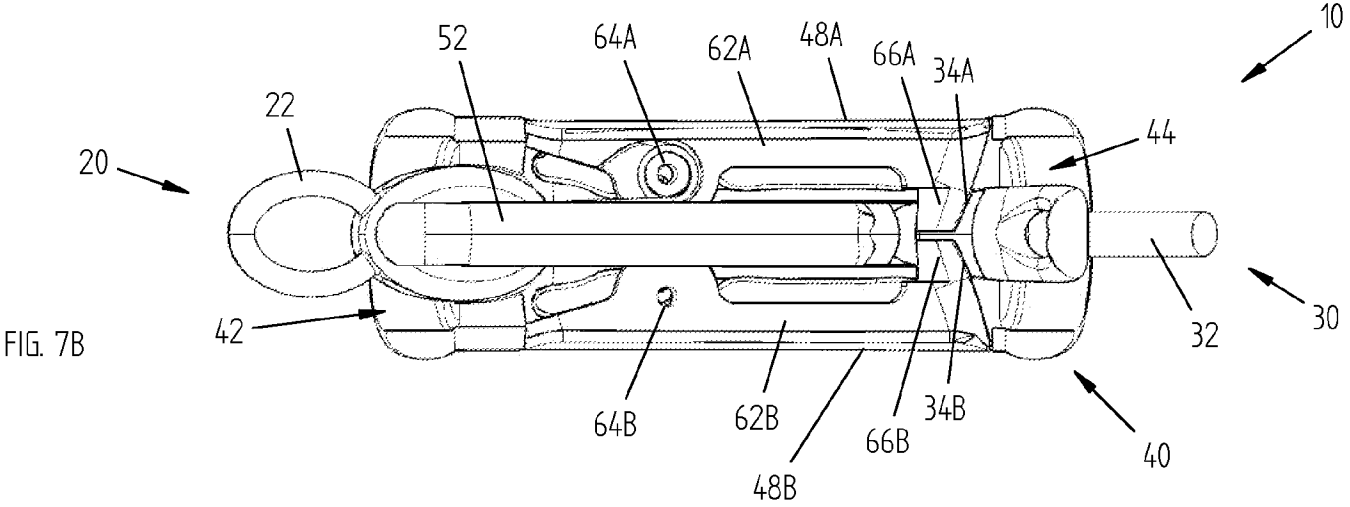
Figure 8:
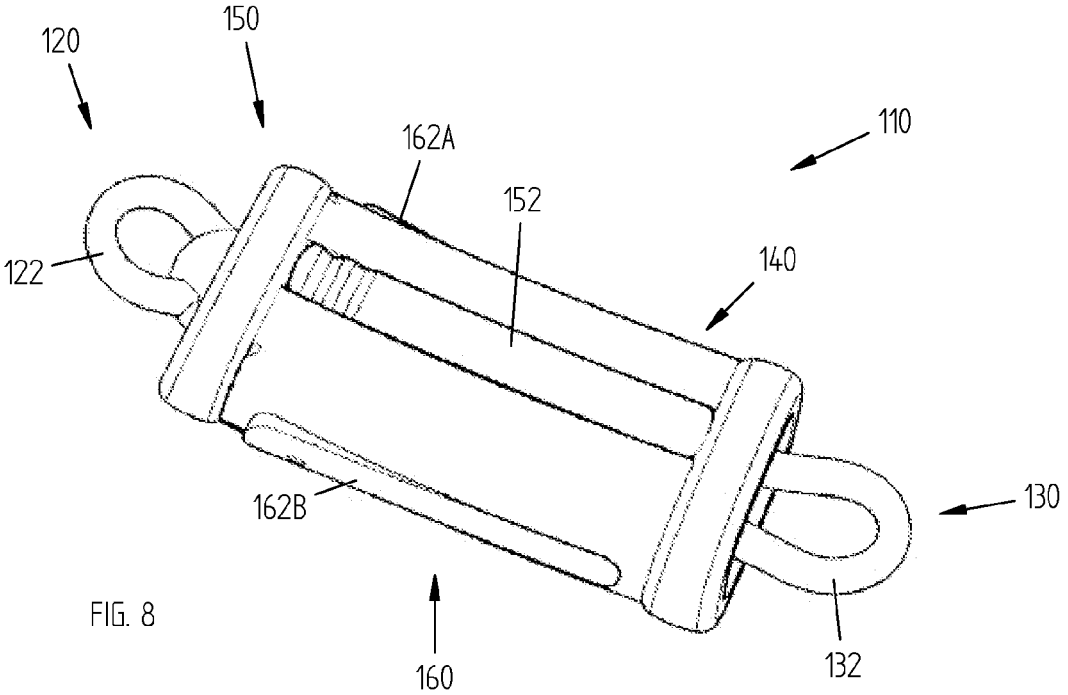
Figure 9:
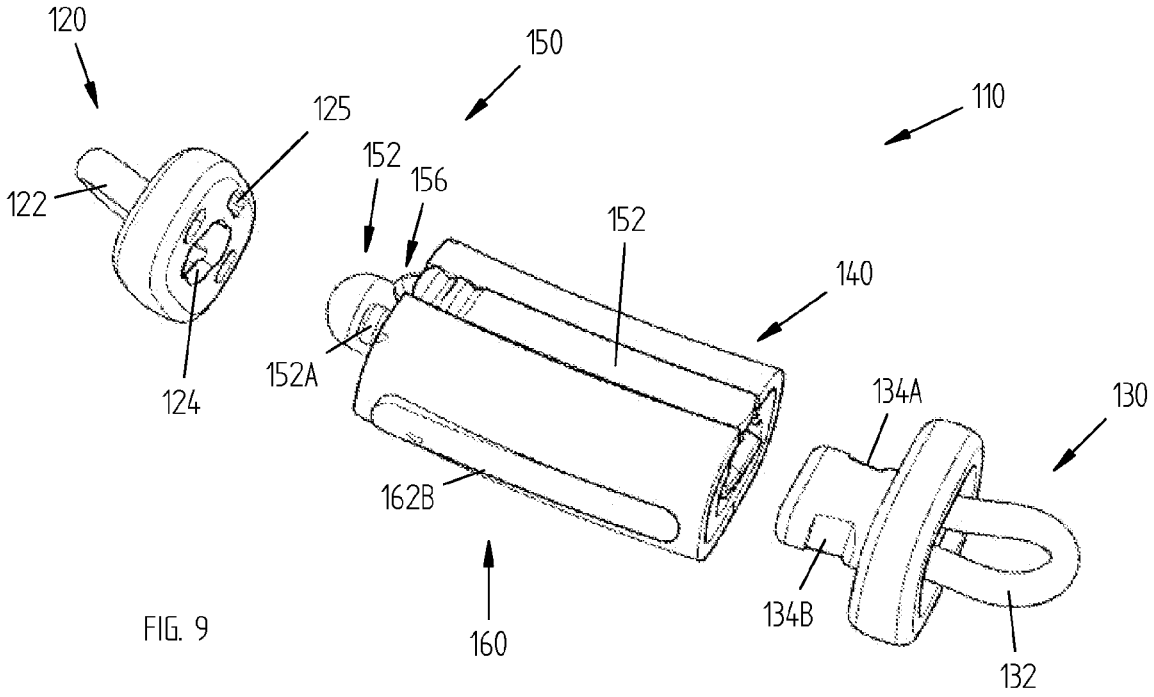
Figure 10:
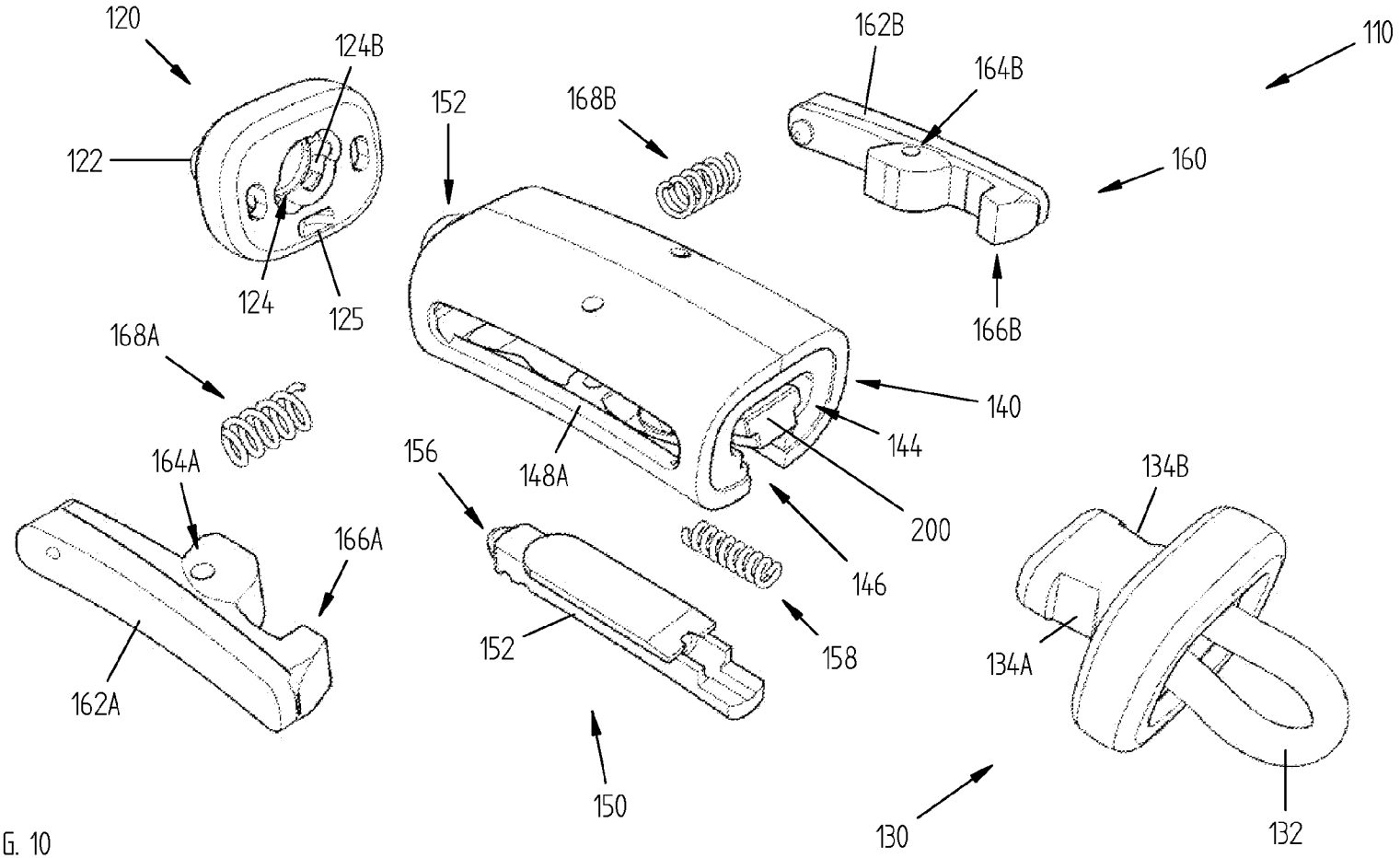
Figure 11:
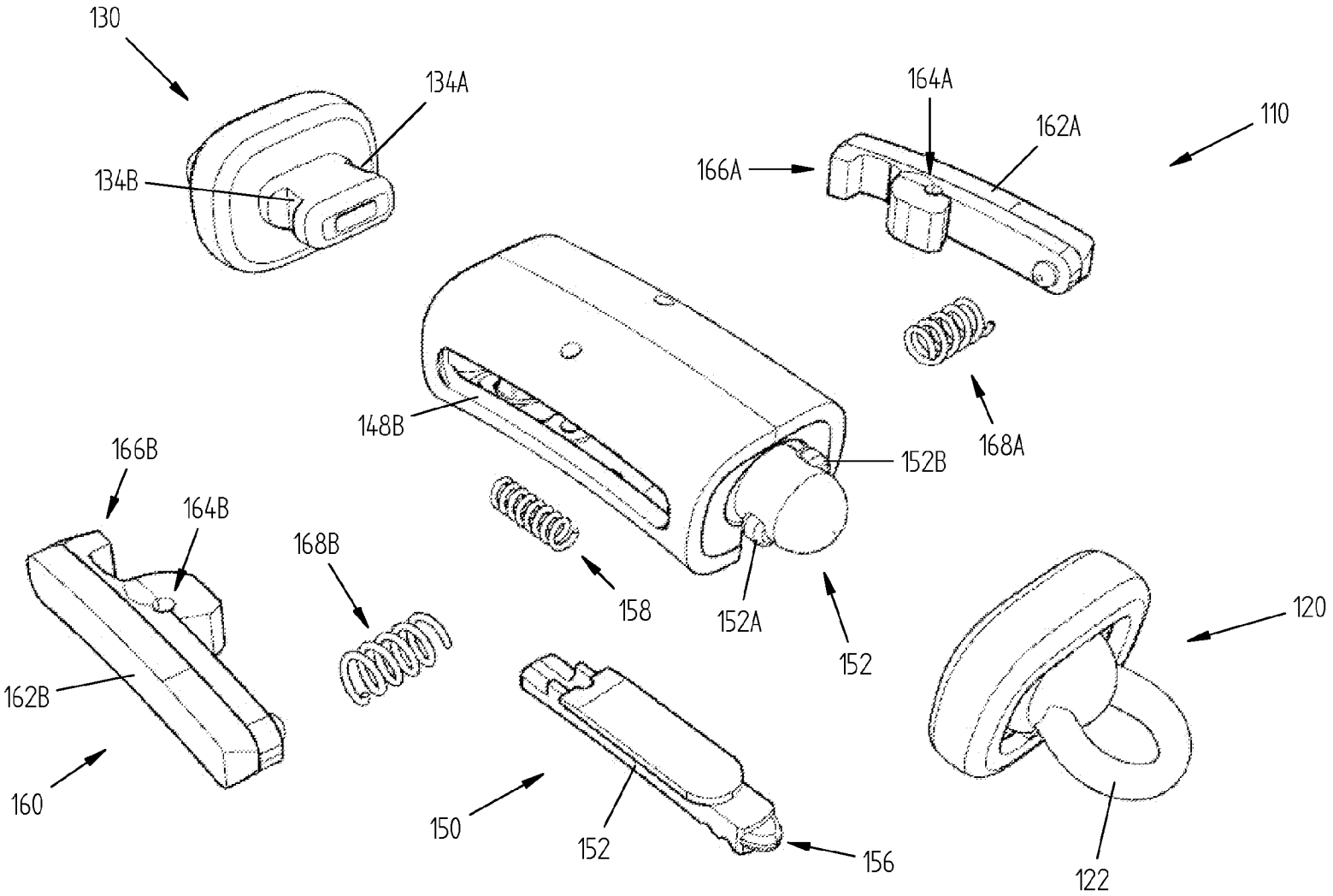
Figure 14:
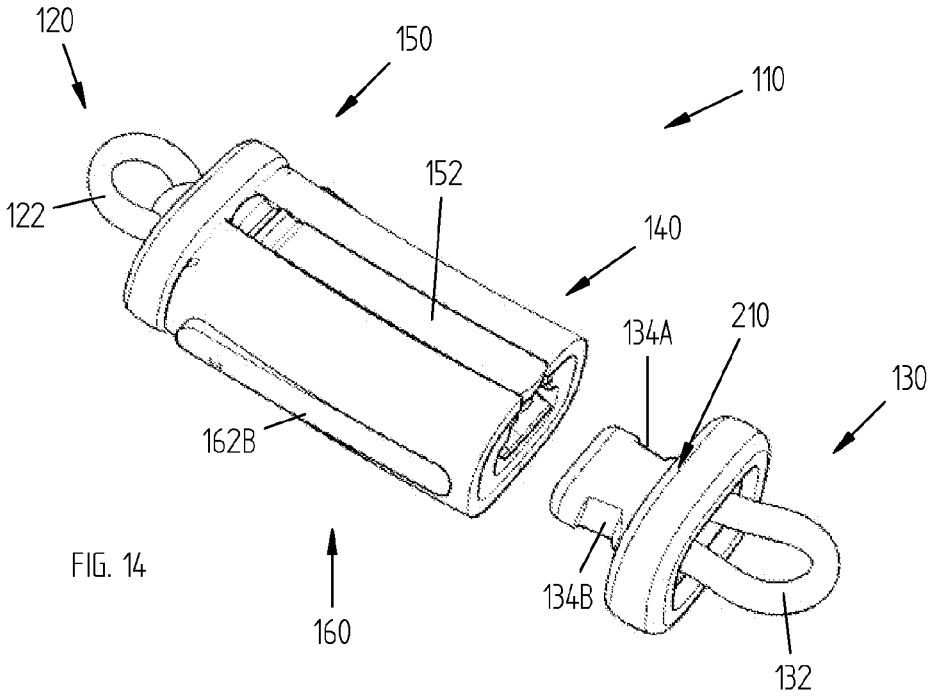
Figure 15:
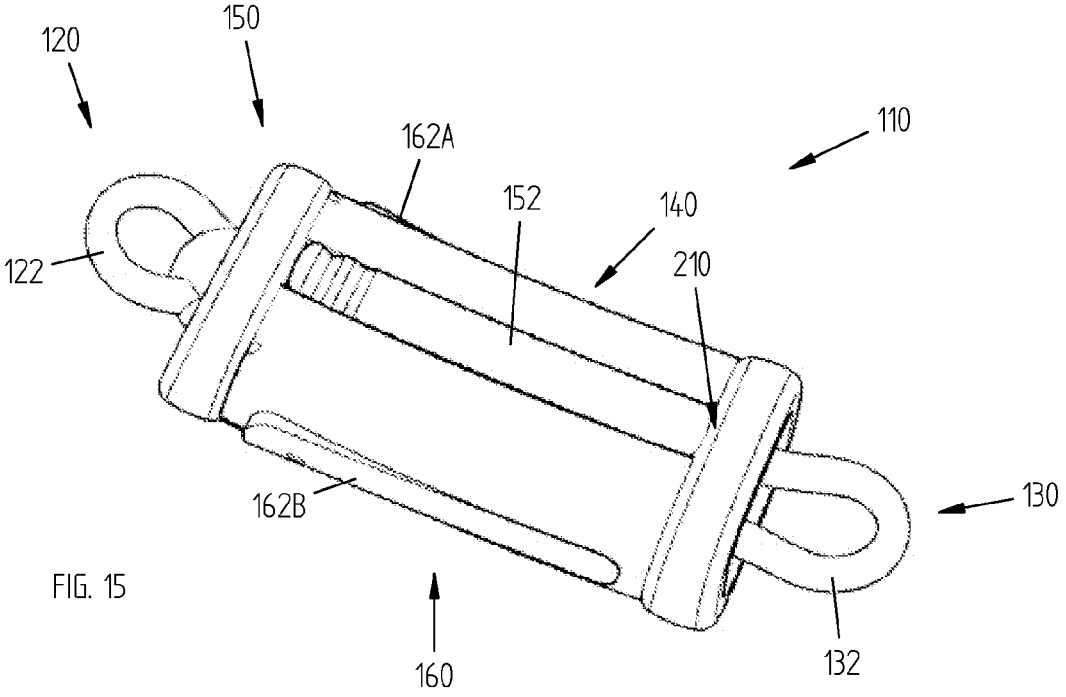
Figure 14A:
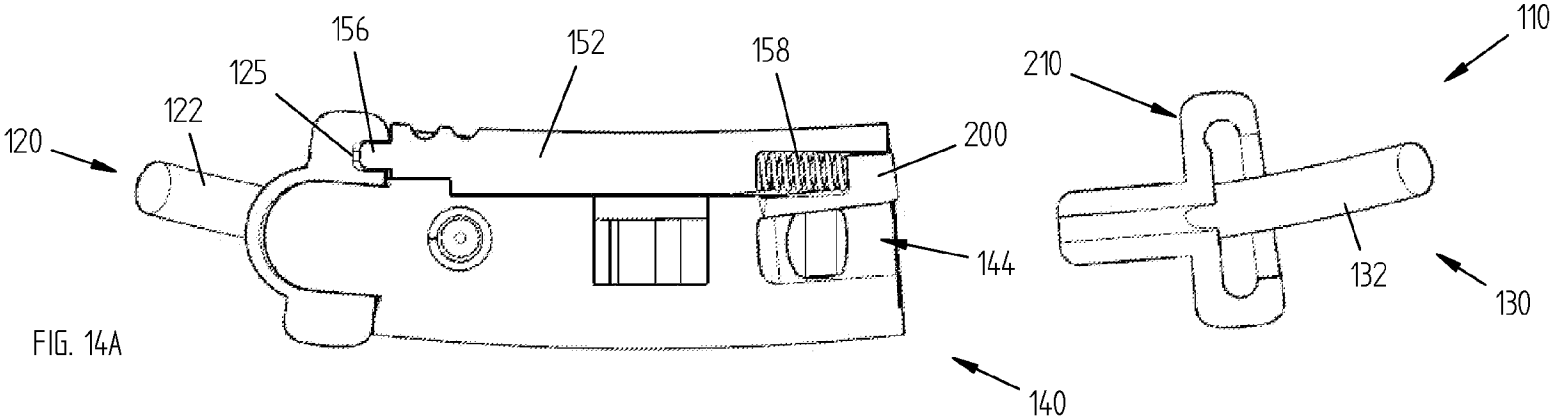
Figure 14B:
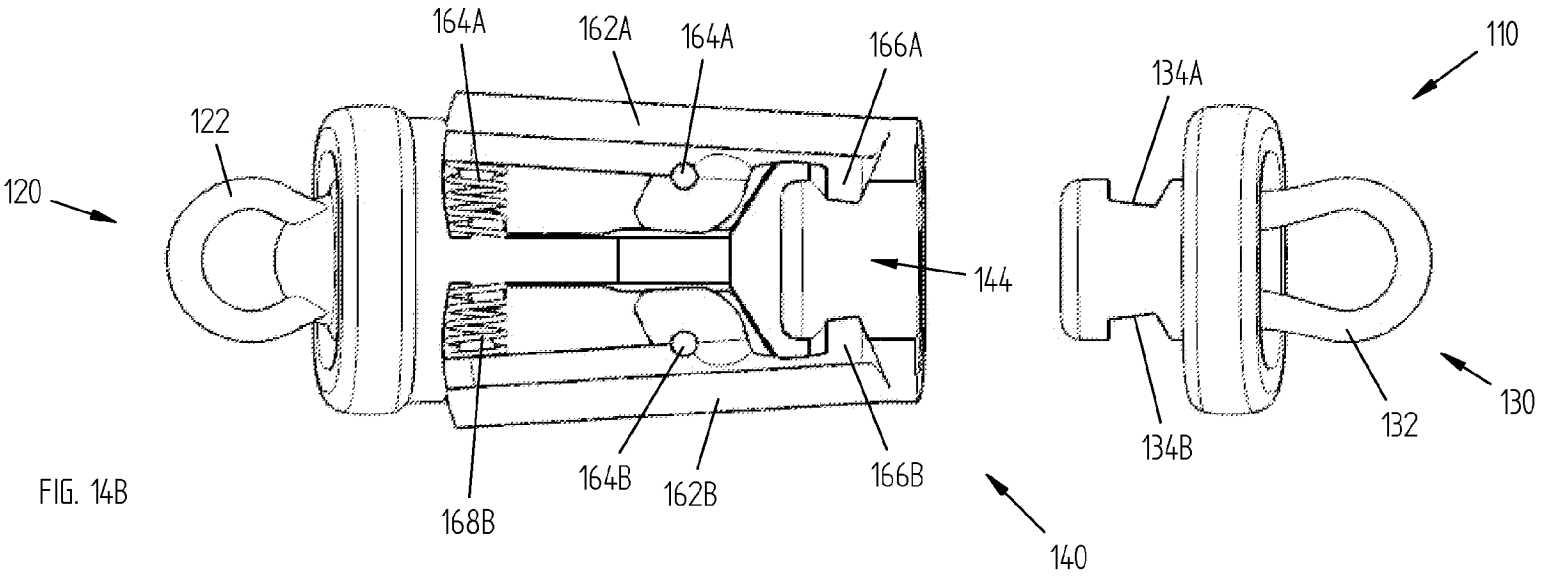
Figure 15A:
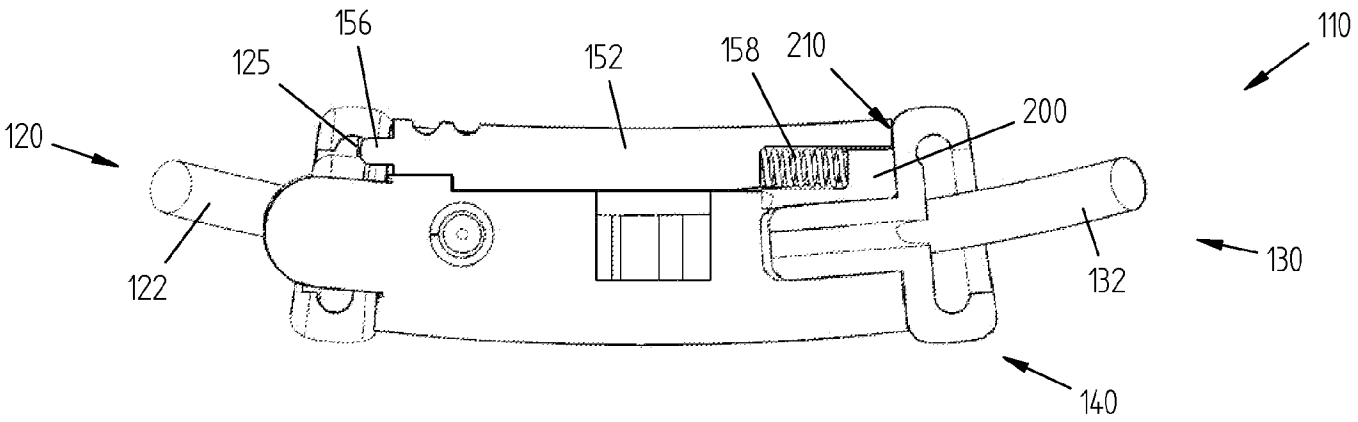
Figure 15B:
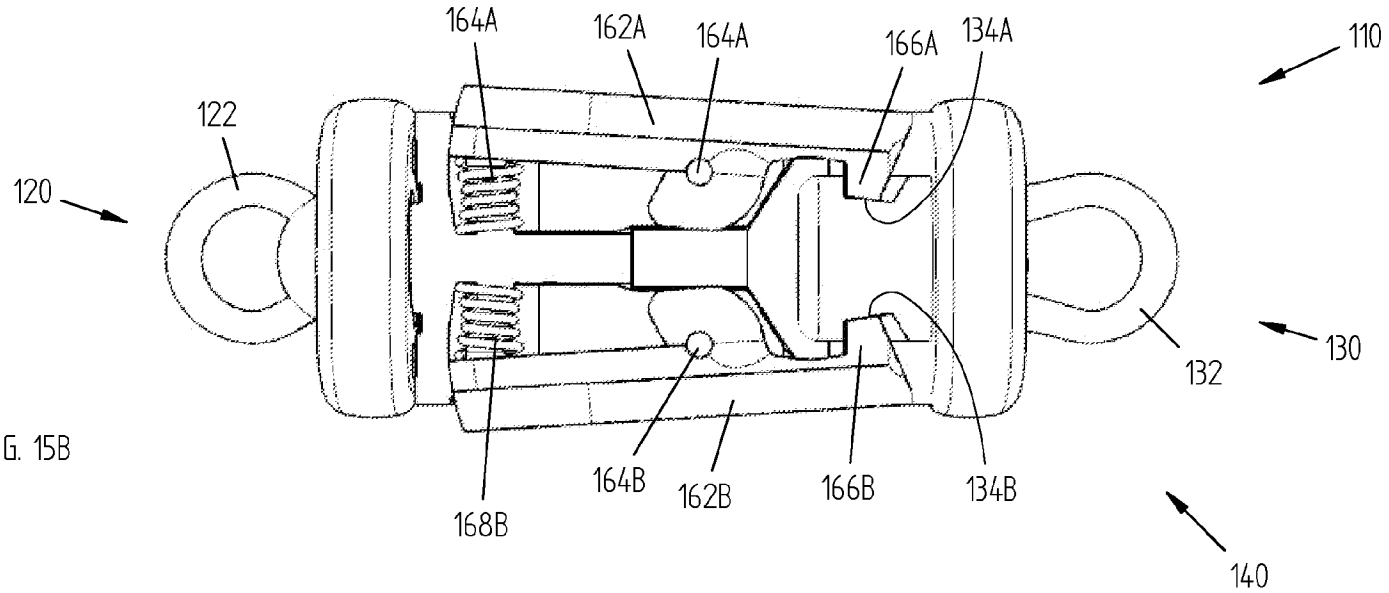
Figure 16:
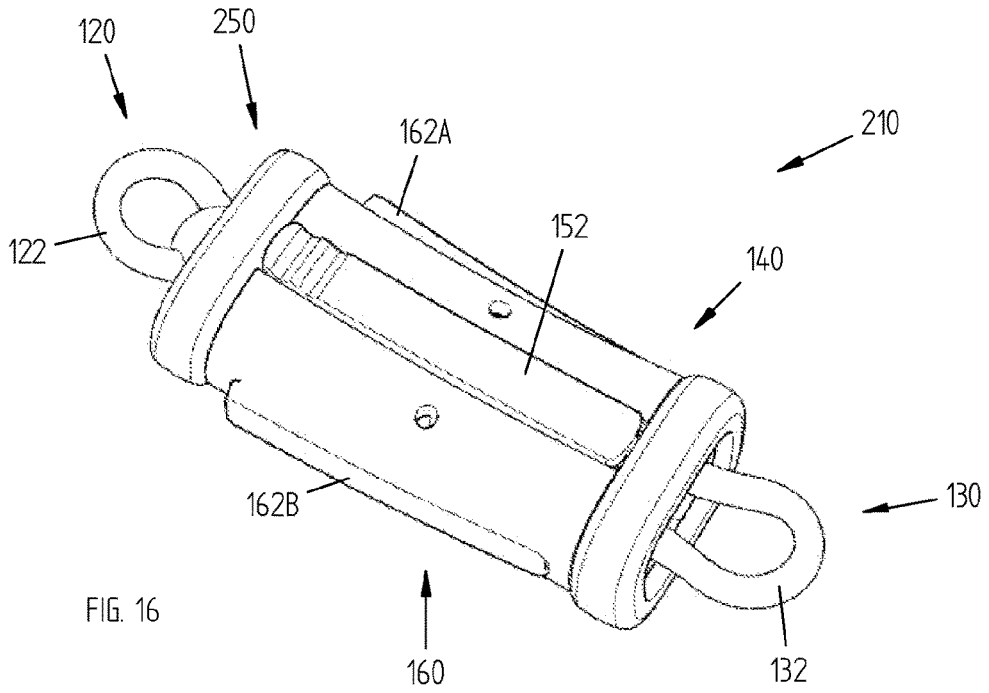
Figure 17:
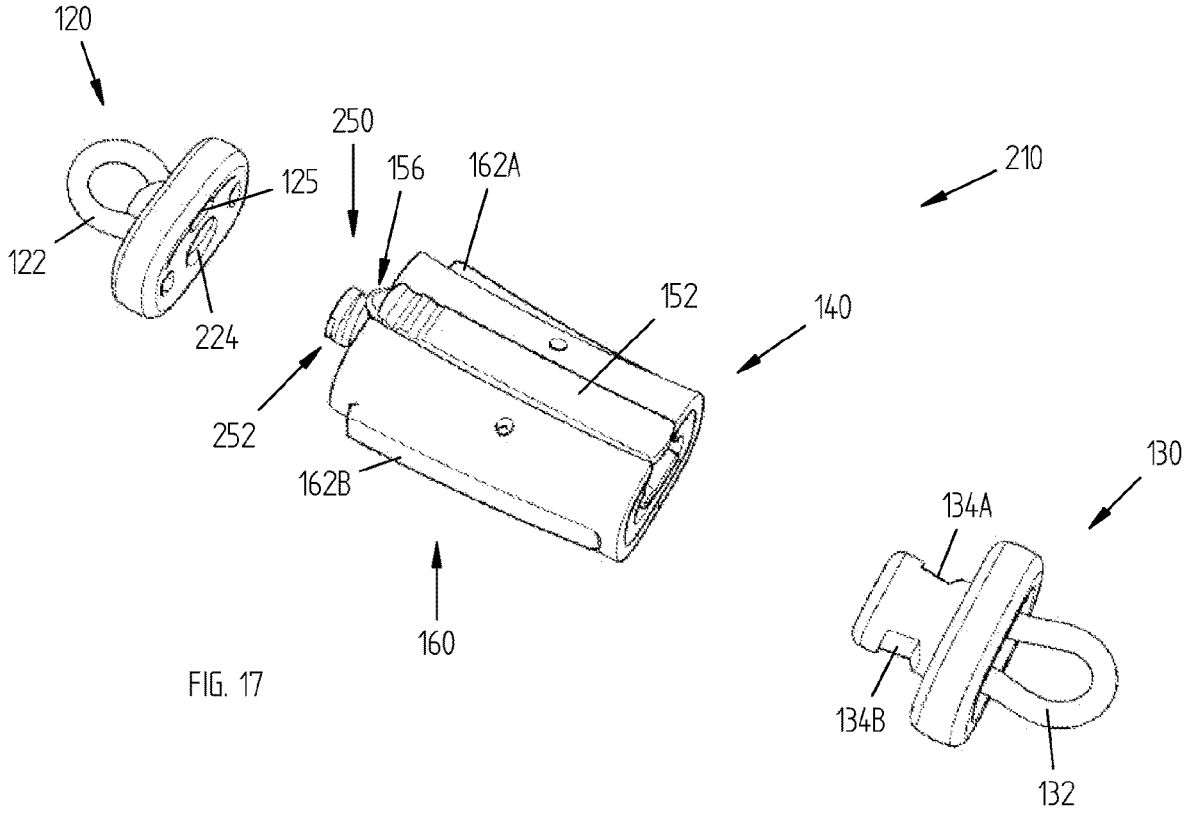
Figure 18:
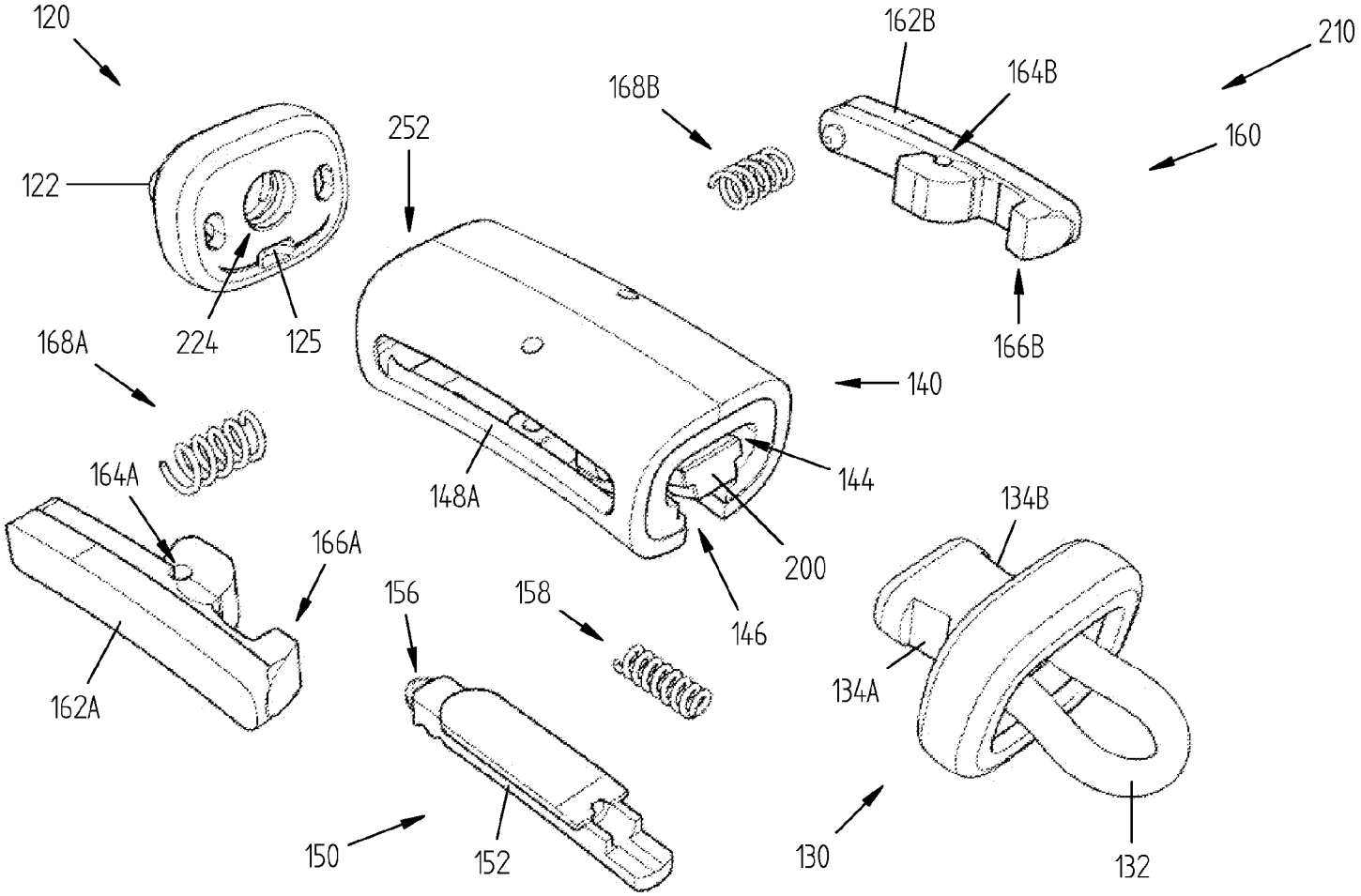
Figure 19:
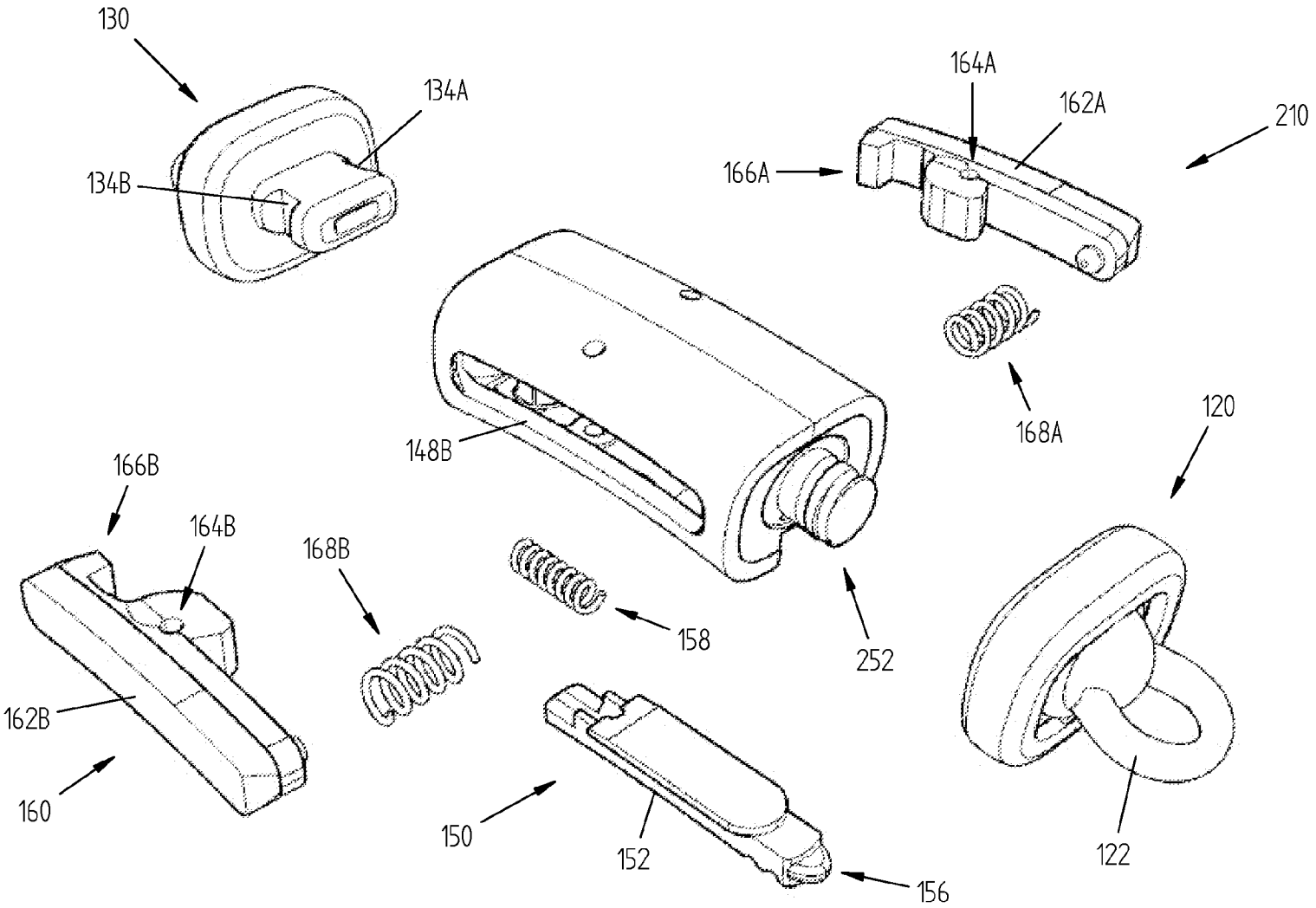

FIGS. from 5 to 7 show different stages of use of the device of FIG. 1;

FIG. 6A shows a sectional view along a vertical section plane of FIG. 6;

FIG. 6B shows a sectional view along a horizontal section plane of FIG. 6;

FIG. 7A shows a sectional view along a vertical section plane of FIG. 7;

FIG. 7B shows a sectional view along a horizontal section plane of FIG. 7;

FIG. 8 shows an axonometric view of a fastening and/or connection device according to another preferred embodiment of the invention in the engaged operating configuration;

FIG. 9 shows an axonometric view of the fastening and/or connection device of FIG. 8 in the disengaged operating configuration;

FIG. 10 shows an exploded view of FIG. 8;

FIG. 11 shows the view of FIG. 10 from another point of view;

FIGS. from 12 to 15 show different stages of use of the device of FIG. 8;

FIG. 14A shows a sectional view along a vertical section plane of FIG. 14;

FIG. 14B shows a sectional view along a horizontal section plane of FIG. 14;

FIG. 15A shows a sectional view along a vertical section plane of FIG. 15;

FIG. 15B shows a sectional view along a horizontal section plane of FIG. 15;

FIG. 16 shows a variant embodiment of the fastening and/or connection device of FIG. 8 in the engaged operating configuration;

FIG. 17 shows an axonometric view of the fastening and/or connection device of FIG. 16 in the disengaged operating configuration;

FIG. 18 shows an exploded view of FIG. 16;

FIG. 19 shows the view of FIG. 18 from another point of view.

DETAILED DESCRIPTION OF THE PRESENT INVENTION

Even though the present invention is described below making reference to its embodiments illustrated in the drawings, the present invention is not limited to the embodiments described below and illustrated in the drawings.

On the contrary, the embodiments described and illustrated in the drawings clarify some aspects of the present invention, the scope of which is defined in the claims. The present invention can be specifically but not exclusively applied in the field of jewellery and/or costume jewellery. More specifically, the fastening and/or connection device according to the present invention can be advantageously applied to jewellery and/or costume jewellery items such as, for example, necklaces, chains, bracelets, pendants, charms and similar items. For this reason, the present invention is described below with special reference to its application to jewellery and/or costume jewellery items.

A first embodiment of the fastening and/or connection device 10 according to the present invention is described below with reference to FIGS. from 1 to 7. For the sake of simplicity, in the continuation of the present description the fastening and/or connection device 10 is simply referred to as fastening device 10.

Figure 1A:
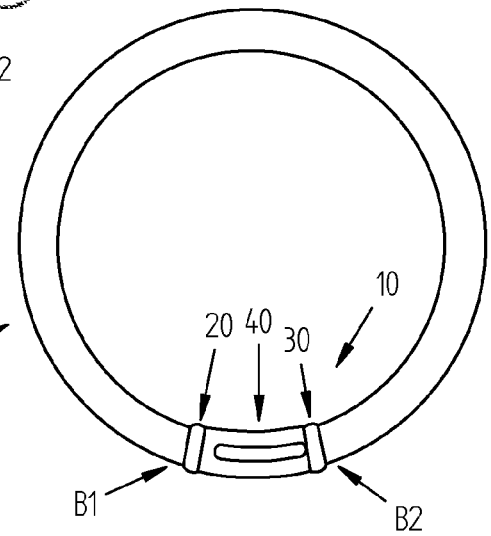
FIG. 1A shows a bracelet using the fastening and/or connection device of FIG. 1 according to a preferred embodiment of the invention.
Figure 2:
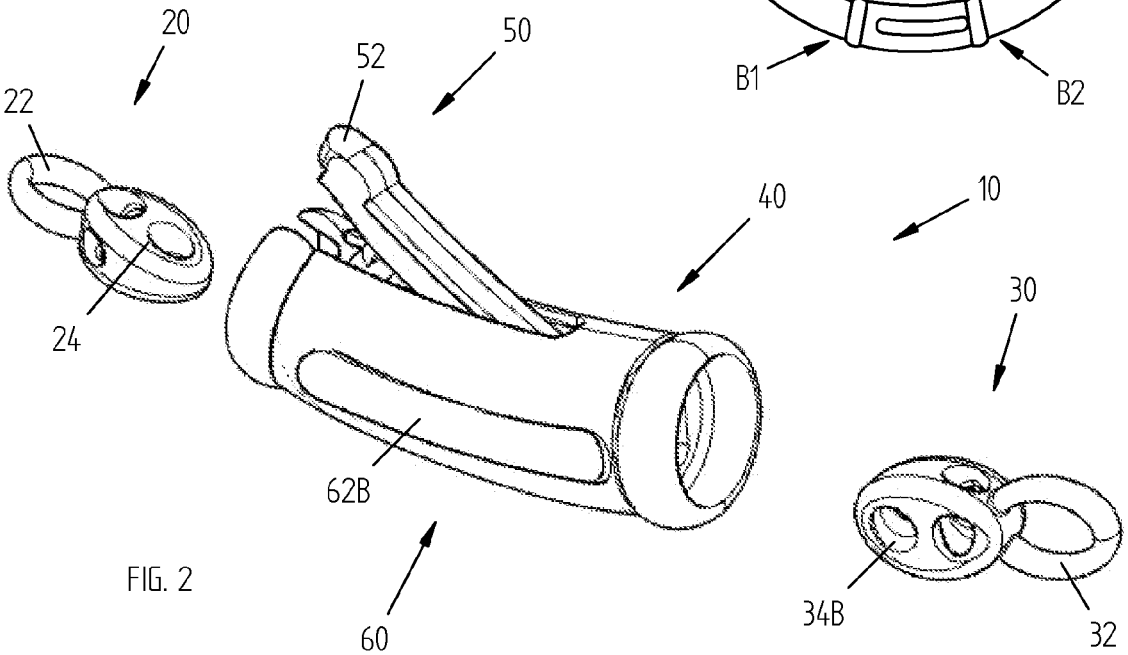
FIG. 2 shows an axonometric view of the fastening and/or connection device of FIG. 1 in the disengaged operating configuration.
Figure 3:
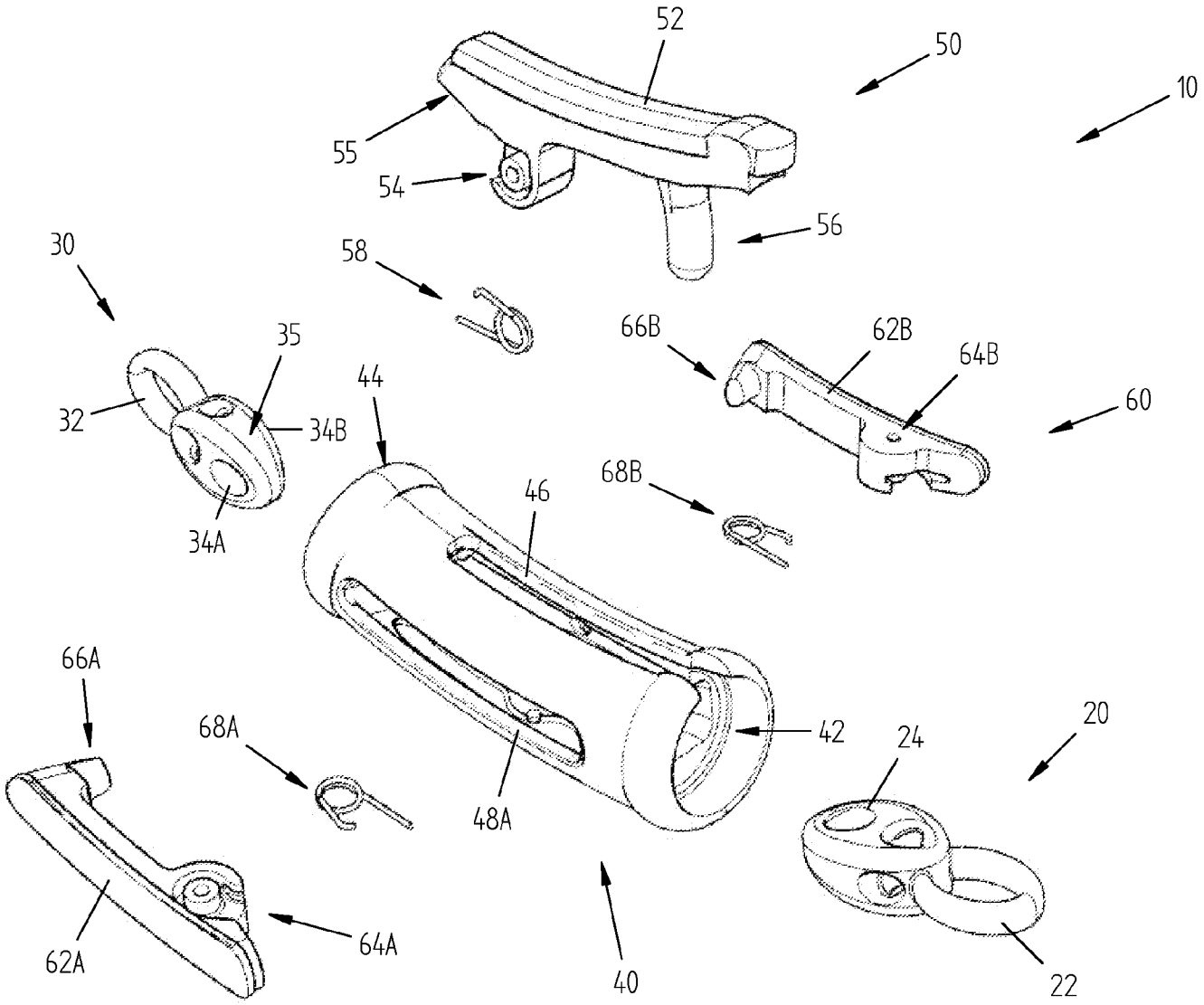
FIG. 3 shows an exploded view of FIG. 1.
Figure 4:
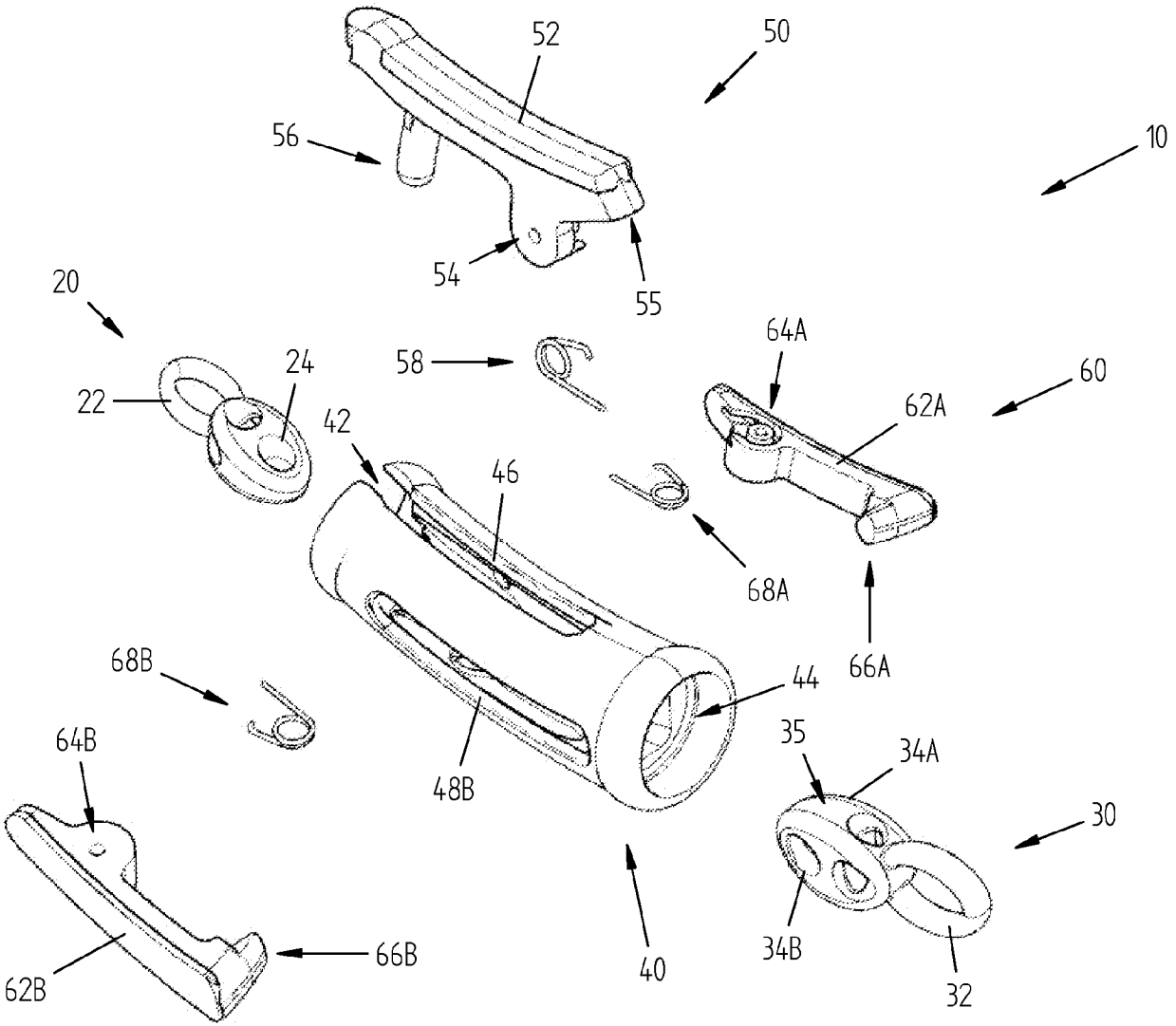
FIG. 4 shows the view of FIG. 3 from another point of view.

The fastening device 10 essentially comprises a first portion 20, a second portion 30 and a main body 40 suited to be interposed between the two portions 20, 30. The portions 20, 30 and the main body 40 are suited to interact so that they can be mutually coupled (see, for example, FIGS. 1 and 7) and uncoupled (see, for example, FIGS. 2 and 5) in such a way as to respectively allow the fastening and unfastening of a jewellery and/or costume jewellery item comprising, for example, a necklace, a bracelet or a similar item. By way of example, FIG. 1A shows the fastening and/or connection device 10 used in a bracelet B. As a whole, the fastening and/or connection device 10 and the bracelet B define more generally an ornamental item.

The first portion 20 is suited to be connected to a first free end B1 of the item B and the second portion 30 is suited to be connected to a second free end B2 of the item B.

As can be seen in FIG. 1, the fastening device 10 as a whole has preferably a substantially cylindrical, slightly curved external shape, which gives it a particular appearance. In variant embodiments, however, said shape can be different, so as to meet different needs and/or tastes.

The first portion 20 of the fastening device 10 comprises a first connection area 22 for connection to a first free end B1 of the item B. Preferably, the first connection area 22 comprises a ring for connection to said first free end of the item.

Analogously, the second portion 30 of the fastening device 10 comprises a second connection area 32 for connection to a second free end B2 of the item B. Preferably, the second connection area 32 comprises a ring for connection to said second free end of the item.

It is evident that in different variant embodiments the connection to the ends of the item can be carried out in a different way and according to the shape of said ends.

Said connection, furthermore, can be carried out according to a method known per se in the sector, for example through welding, gluing or through another equivalent connection means, typically according to the type of material used for the fastening device 10 and for the respective portions 20, 30.

In a preferred embodiment, for example, the first connection area and/or the second connection area are coupled with the respective free end of the item by burying them therein, especially in the case of plastic materials and/or rubbers and/or silicone and/or caoutchouc. For example, as shown for the bracelet B of FIG. 1A, the first connection area 22 and the second connection area 32 are connected to/buried in the free ends B1, B2 of the bracelet B during assembly, in particular when the material used to make the bracelet B is a plastic material and/or rubber and/or silicone and/or caoutchouc.

In another preferred embodiment, for example, the ring 22, 32 can be coupled with the respective free end of the item through a seam, in particular in the case of leather and/or fabric materials.

According to an advantageous aspect of the invention, the fastening device 10 comprises first connection means 50 suited to arrange the main body 40 and the first portion 20 in the mutual operating configurations of disengagement and engagement. The fastening device 10 comprises, furthermore, second connection means 60 suited to arrange the main body 40 and the second portion 30 in the mutual operating configurations of disengagement and engagement.

The main body 40 preferably comprises a tubular element suited to receive at least part of the first and of the second connection means 50, 60 within itself.

The first connection means 50 preferably comprise a movable engagement element 52 hinged to the main body 40 and a holding seat 24 associated with the first portion 20.

The movable element 52 is constrained to the main body 40 preferably through a rotation pin 54 and comprises an engagement portion 56, or holding pin, arranged on the opposite side with respect to the rotation pin 54.

The holding seat 24 preferably comprises a through hole suited to receive the holding pin 56 when the main body 40 and the first portion 20 are in the engaged operating configuration.

Figure 5:
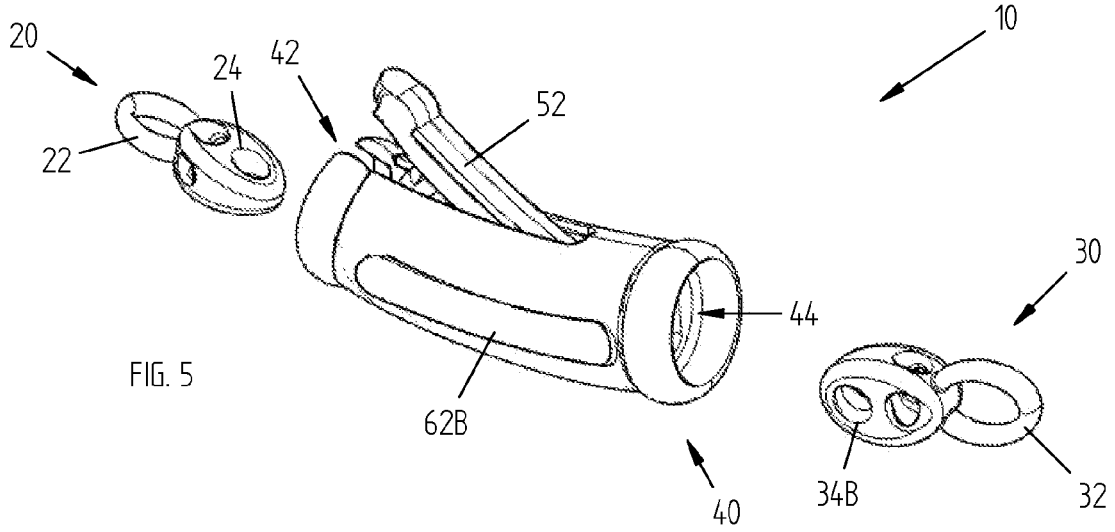

The movable element 52 can be moved around the rotation pin 54 and can advantageously assume a first disengaged or unfastened position (for example, as shown in FIG. 5) and a second engaged or fastened position (for example, as shown in FIG. 7).

Preferably, an elastic thrusting element 58, preferably a helical spring, tends to maintain the movable element 52 in the engaged position. The elastic thrusting element 58 is interposed between the main body 40 and the movable element 52. The second connection means 60 preferably comprise one pair of movable engagement elements 62A, 62B hinged to the main body 40 and two holding seats 34A,34B associated with the second portion 30.

The movable elements 62A, 62B are constrained to the main body 40 preferably through rotation pins 64A, 64B and comprise engagement portions 66A, 66B, or holding pins, arranged on the opposite side with respect to the rotation pins 64A, 64B The holding seats 34A, 34B preferably comprise two seats defined by a through opening and suited to receive the holding pins 66A, 66B when the main body 40 and the second portion 30 are in the engaged operating configuration.

The movable elements 62A, 62B can be moved around respective rotation pins 64A, 64B and can advantageously assume a first disengaged or unfastened position and a second engaged or fastened position (for example, as shown in FIG. 7). Preferably, elastic thrusting elements 68A, 68B, preferably helical springs, tend to maintain the movable elements 62A, 62B in the engaged position. The elastic thrusting elements 68A, 68B are interposed between the main body 40 and the movable elements 62A, 62B.

The main body 40 preferably comprises a first opening 42 suited to receive the first portion 20 and a second opening 44 suited to receive the second portion 30. Preferably, the main body 40 comprises also a third opening 46 suited to receive the movable element 52 of the first connection means 50, a fourth opening 48A suited to receive the first movable element 62A of the second connection means 60 and a fifth opening 48B suited to receive the second movable element 62B of the second connection means 60.

According to a further advantageous aspect, the first connection means 50 and the second connection means 60 interact in such a way that the main body 40 and the second portion 30 are placed in the engaged operating configuration through the second connection means 60 only once the main body 40 and the first portion 20 have been placed in the engaged operating configuration through the first connection means 50.

Vice versa, said first connection means 50 and said second connection means 60 interact in such a way that the main body 40 and the first portion 20 are placed in the disengaged operating configuration through the first connection means 50 only once the main body 40 and the second portion 30 have been placed in the disengaged operating configuration by the second connection means 60.

The above is described in greater detail below with reference to FIGS. from 5 to 7, which illustrate the methods of use of the fastening device 10.

FIG. 5 shows the initial configuration of the fastening device 10, in which the main body 40, the first portion 20 and the second portion 30 are in the disengaged operating configuration.

The movable element 52 of the first connection means 50 is in the open position. The first portion 20 is inserted in the first opening 42 of the main body 40 (FIGS. 6, 6A and 6B). The element 52 is rotated and brought to the fastened position with its holding pin 54 inserted in the holding seat 24 of the first portion 20 (as can be seen, in particular, in FIG. 6A).

The second portion 30 is snap-fitted in the second opening 44 of the main body 40 (FIGS. 7, 7A and 7B). The holding pins 66A, 66B of the movable elements 62A, 62B are inserted in the holding seats 34A, 34B of the second portion 30 (as can be seen, in particular, in FIG. 7B).

In this condition, the device 10 serves the function of fastening the item B. It should be noted that in this condition the first connection means 50 are locked by the second connection means 60. More specifically, as can be understood from FIG. 7A, the rotation of the movable element 52 is prevented by the presence of the second portion 30 inside the main body 40. More particularly, should it be attempted to perform a rotation, a rear surface 55 of the movable element 52 interferes with the external surface 35 of the second portion 30.

As far as the opening of the fastening device 10 is concerned, first of all the second portion 30 is disengaged from the main body 40. When the movable elements 62A, 62B are rotated manually, the holding pins 66A, 66B are extracted from the holding seats 34A, 34B of the second portion 30. The second portion 30 can then be withdrawn from the main body 40 (FIG. 6).

After this operation, the first connection means 50 are released. In particular, the movable element 52 is free to rotate.

Thus, when the movable element 52 is rotated manually, the holding pin 56 is extracted from the holding seat 24 of the first portion 20. The first portion 20 can then be withdrawn from the main body 40 (FIG. 5).

According to the above, the device 10 according to the invention serves the function of connecting and separating the free ends B1, B2 of the item B.

It should be noted that, advantageously, it is possible to make the main body 40 so that it is interchangeable in order to meet the user's different needs. For example, it is possible to provide different main bodies, equal to one another but having different ornamental patterns on their external surface, so that the desired main body can be used from time to time. In other cases, different main bodies in different shapes may be provided, for example not necessarily in a curved cylindrical shape, as shown in the figures, but in a different shape.

According to a further advantageous aspect, it is possible to use the same item B, to whose free ends B1, B2 the respective portions 20, 30 of the fastening device 10 are connected, and then to use a main body chosen from among two or more main bodies made available to the user.

Still advantageously, it is possible to use the same main body 40 in items of different types, for example in items made of different materials, precious and non-precious (such as, for example, platinum, gold, silver, brass or silicone, rubber, leather etc).

For example, it is possible to provide two or more items B to whose free ends B1, B2 the respective portions 20, 30 of a fastening device 10 are connected. For said two or more items B it is then possible to use the same main body 40 from time to time.

For example, it is possible to provide two or more bracelets B, for example several bracelets in silicone having different colours and/or lengths, provided with corresponding portions 20, 30. Then, it is possible to provide just one main body 40 to be used from time to time with the bracelet actually worn.

In this way, it is possible to wear a bracelet of choice, in a different colour and/or length (more generally, with a different ornamental pattern), using the same main body.

A second embodiment of the fastening and/or connection device 110 according to the present invention, here below simply referred to as fastening device 110, is described below with reference to FIGS. from 8 to 15.

The fastening device 110 essentially comprises a first portion 120, a second portion 130 and a main body 140 suited to be interposed between the two portions 120, 130.

The portions 120, 130 and the main body 140 are suited to interact so that they can be coupled with each other (see, for example, FIGS. 8 and 15) and uncoupled (see, for example, FIGS. 9 and 12) so as to respectively allow the fastening and unfastening of the jewellery and/or costume jewellery item, not shown in the figures.

The first portion 120 is suited to be connected to a first free end of the item and the second portion 130 is suited to be connected to a second free end of the item. Preferably, the fastening device 110 as a whole has a substantially parallelepiped external shape with rounded corners, which results in a particular appearance. In variant embodiments, however, a different shape can be selected in order to meet different needs and/or tastes.

The first portion 120 of the fastening device 110 comprises a first connection area 122 for connection to a first free end of the item. Preferably, the first connection area 122 comprises a ring for connection to said first free end of the item. Analogously, the second portion 130 of the fastening device 110 comprises a second connection area 132 for connection to a second free end of the item.

Preferably, the second connection area 132 comprises a ring for connection to said second free end of the item.

It is evident that in different variant embodiments the connection to the ends of the item can be carried out in a different way and according to the shape of said ends. Said connection, furthermore, can be carried out according to a method known per se in the sector, for example through welding, gluing or through another equivalent connection means, typically according to the type of material used for the fastening device 110 and for the respective portions 120, 130.

In a preferred embodiment, for example, the first connection area and/or the second connection area are coupled with the respective free end of the item by burying them therein, especially in the case of plastic materials and/or rubbers and/or silicone and/or caoutchouc.

As described above, for example, the first connection area and the second connection area are connected to/buried in the free ends of the item during assembly, especially when the material of the item is a plastic material and/or a rubber and/or silicone and/or caoutchouc.

In another preferred embodiment, for example, the ring 122, 132 can be coupled with the respective free end of the item through a seam, especially in the case of leather and/or fabric materials.

According to an advantageous aspect of the invention, the fastening device 110 comprises first connection means 150 suited to arrange the main body 140 and the first portion 120 in the mutual operating configurations of disengagement and engagement. The fastening device 110 comprises, furthermore, second connection means 160 suited to arrange the main body 140 and the second portion 130 in the mutual operating configurations of disengagement and engagement.

The main body 140 preferably comprises a tubular element suited to receive at least part of the first and of the second connection means 150, 160 within itself. The main body 140 preferably comprises an opening 144 suited to receive the second portion 130.

The first connection means 150 preferably comprise a pin 152 projecting from the main body 140 and a holding seat 124 associated with the first portion 120.

The projecting pin 152 is preferably provided with one pair of projections 152A, 152B and the holding seat 124 is provided with corresponding recessed seats 124A, 124B (only one seat 124B is visible in the figures) to allow a mutual connection of the bayonet type, that is, a connection that is obtained through the insertion of the pin 152 in the seat 124 in the axial direction and then through a mutual rotation of the projections 152A, 152B which slide in the recessed seats 124A, 124B.

The first portion 120 is also provided with a locking seat 125 suited to receive the end 156 of a locking element 152. The locking element 152 comprises a rod 152 which slides along the main body 140 in an appropriate seat 146.

Preferably, an elastic thrusting element 158, preferably a helical spring, is interposed between the locking element 152 and a holding element 200 (in FIG. 10 the holding element 200 is shown in a lifted position, before assembly).

The elastic thrusting element 158 tends to push the locking element 152 towards the engaged position, meaning the position in which the locking seat 125 of the first portion 120 is aligned with the end 156 of the locking element 152 and receives it within itself.

The second connection means 160 preferably comprise one pair of movable engagement elements 162A, 162B hinged to the main body 140 and two holding seats 134A, 134B associated with the second portion 130.

The movable elements 162A, 162B are constrained to the main body 140 preferably through rotation pins 164A, 164B and comprise engagement portions 166A, 166B, or holding pins.

The holding seats 134A, 134B preferably comprise two undercut areas suited to receive the holding pins 166A, 166B which come in contact with them when the main body 140 and the second portion 130 are in the engaged operating configuration.

The movable elements 162A, 162B can be moved around the respective rotation pins 164A, 164B and can advantageously assume a first disengaged or open position and a second engaged or fastened position (as shown, for example, in FIG. 15B).

Preferably, the elastic thrusting elements 168A, 168B, preferably helical springs, tend to maintain the movable elements 162A, 162B in the engaged position. The elastic thrusting elements 168A, 168B are interposed between the main body 140 and the movable elements 162A, 162B.

Preferably, the main body 140 comprises also a first opening 148A suited to receive the first movable element 162A of the second connection means 160 and a second opening 148B suited to receive the second movable element 162B of the second connection means 160.

According to a further advantageous aspect, the first connection means 150 and the second connection means 160 interact in such a way that the main body 140 and the second portion 130 are arranged in the engaged operating configuration through the second connection means 160 only once the main body 140 and the first portion 120 have been arranged in the engaged operating configuration through the first connection means 150.

Vice versa, said first connection means 150 and second connection means 160 interact in such a way that the main body 140 and the first portion 120 are arranged in the disengaged operating configuration through the first connection means 150 only once the main body 140 and the second portion 130 have been arranged in the disengaged operating configuration by the second connection means 160.

Figure 12:
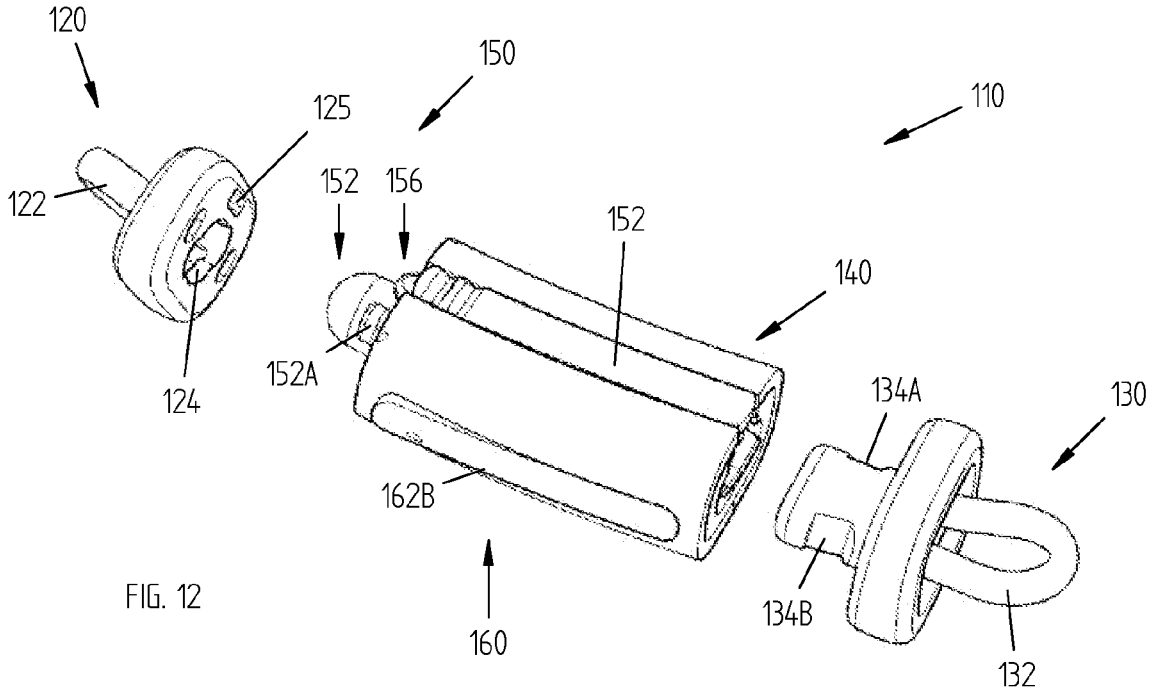

The above is described in greater detail below making reference to FIGS. from 12 to 15, in which the methods of use of the fastening device 110 are illustrated. FIG. 12 shows the initial configuration of the fastening device 110, in which the main body 140, the first portion 120 and the second portion 130 are in the disengaged operating configuration.

Figure 13:
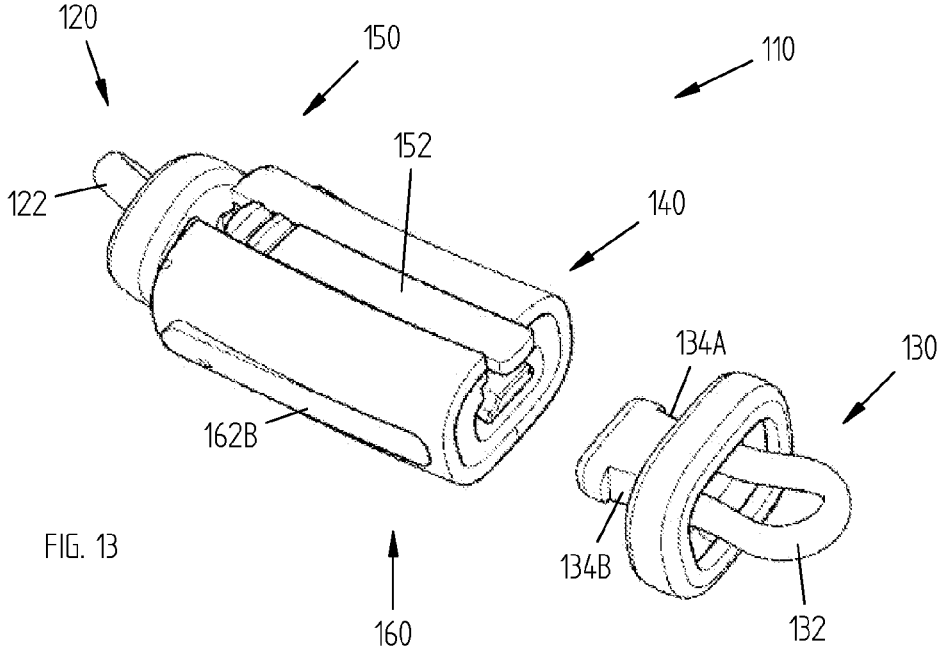

The first portion 120 is connected to the main body 140 by inserting the projecting pin 152 of the main body 140 axially in the holding seat 124 of the first portion 120 and then rotating it to obtain the bayonet connection (FIG. 13). At the end of the rotation (FIG. 14), the locking seat 125 of the first portion 120 is aligned with the end 156 of the locking element 152 and the elastic thrusting element 158 thrusts the locking element 152 in the engaged position.

The second portion 130 is then snap-fitted in the second opening 144 of the main body 140 (FIG. 15). The holding pins 166A, 166B of the movable elements 162A, 162B become engaged in the undercut surfaces 134A, 134B of the second portion 130 (as can be seen in FIG. 15B).

The second portion 130 is locked on the main body 140 and in its turn the locking element 152 is locked axially by a contact surface 210 of the second portion 130. In this condition, the device 110 serves the function of fastening the item.

As far as the unfastening of the fastening device 110 is concerned, first of all the second portion 130 is disengaged from the main body 140. When the movable elements 162A, 162B are rotated manually, the holding pins 166A, 166B are extracted from the undercut surfaces 134A, 134B of the second portion 130. The second portion 130 can then be withdrawn from the main body 140 (FIG. 14). After this operation, the locking element 152 is free and can be manually brought to the retracted position.

The end 156 of the locking element 152 is extracted from the locking seat 125 of the first portion 120 and the first portion 120 can thus be rotated (FIG. 13) and then translated so that it can be withdrawn from the main body 140 (FIG. 12). According to the above, the device 110 according to the invention serves the function of connecting and separating the free ends of the item.

This embodiment makes it possible to obtain the same advantages described above with reference to the first embodiment.

Advantageously, it is possible to use the same item to whose free ends the respective portions 120, 130 of the fastening device 110 are connected, and successively to use a main body selected from among two or more main bodies made available to the user.

Still advantageously, it is possible to use the same main body 140 in items of different types, for example in items made of different materials, precious and non-precious (such as, for example, platinum, gold, silver, brass or silicone, rubber, leather etc).

For example, it is possible to provide two or more items to whose free ends the respective portions 120, 130 of a fastening device 110 are connected. For said two or more items it is then possible to use the same main body 140 from time to time. For example, it is possible to provide two or more bracelets, for example several bracelets in silicone having different colours and/or lengths, provided with corresponding portions 120, 130. Furthermore, it is possible to provide just one main body 140 to be used from time to time with the bracelet actually worn.

In this way, it is possible to wear a bracelet of choice, in a different colour and/or length (more generally, with a different ornamental pattern), using the same main body.

FIGS. from 16 to 19 show a fastening device 210 according to another preferred variant embodiment of the invention. The component parts equivalent to those of the preferred embodiment described with reference to FIGS. from 8 to 15 are identified by the same reference numbers.

The embodiment shown in the figures differs from the embodiment previously described above with reference to FIGS. from 8 to 15 in that the first connection means 250 preferably comprise a pin 252 projecting from the main body 140 and a holding seat 224 associated with the first portion 120.

The projecting pin 252 is preferably provided with a thread and the holding seat 224 is provided with a corresponding nut screw.

During use of the fastening device 210, the first portion 120 is connected to the main body 140 through a screwing operation rather than through a bayonet connection as described for the previous embodiment. Vice versa, the first portion 120 is disconnected from the main body 140 through an unscrewing operation.

In the embodiments illustrated and described herein, the connection means preferably comprise seats associated with the first and the second portion, and holding elements, such as pins or projecting parts, associated with movable elements connected to the main body through a joint. In variant embodiments, however, dual configurations may be possible, that is, seats associated with the movable elements connected to the main body through a joint or holding elements, such as pins or projecting parts, associated with the first or the second portion.

In the preceding detailed description of the embodiments of the fastening device according to the present invention which are illustrated in the drawings, it has thus been shown that the device according to the present invention makes it possible to achieve the set objects. More specifically, the device according to the present invention makes it possible to provide a fastening and/or connection device for jewellery and/or costume jewellery items such as, for example, bracelets, chains, pendants or charms, wherein said fastening and/or connection device can be customized in a simple and immediate manner.

Even though the present invention has been illustrated above through the detailed description of its embodiments illustrated in the drawings, the present invention is not limited to the embodiments represented in the drawings and described above. On the contrary, the scope of the present invention is defined in the claims.

The invention claimed is:

1. A fastening and/or connection device (10; 110, 210) for a jewellery and/or costume jewellery item (B), said item (B) comprising a first free end (B1) and a second free end (B2) to be joined, said device (10; 110; 210) comprising a first portion (20; 120) suited to be connected to said first free end (B1) of said item (B) and a second portion (30; 130) suited to be connected to said second free end (B2) of said item (B), wherein said device (10; 110; 210) comprises:

a main body (40; 140) suited to be interposed between said first portion (20; 120) and said second portion (30; 130);

first connection means (50; 150; 250) suited to place said main body (40; 140) and said first portion (20; 120) in a disengaged operating configuration or in an engaged operating configuration;

second connection means (60; 160) suited to place said main body (40; 140) and said second portion (30; 130) in a disengaged operating configuration or in an engaged operating configuration;

wherein, in order to join said free ends (B1, B2) of said item (B), said first connection means (50; 150; 250) and said second connection means (60; 160) interact in such a way that said main body (40; 140) and said second portion (30; 130) are placed in said engaged operating configuration through said second connection means (60; 160) only once, said main body (40; 140) and said first portion (20; 120) have been placed in said engaged operating configuration through said first connection means (50; 150; 250);

wherein, in order to separate said free ends (B1, B2) of said item (B), said first connection means (50; 150; 250) and said second connection means (60; 160) interact in such a way that said main body (40; 140) and said first portion (20; 120) are placed in said disengaged operating configuration through said first connection means (50; 150; 250) only once, said main body (40; 140) and said second portion (30; 130) have been placed in said disengaged operating configuration by said second connection means (60; 160);

wherein said first connection means (150; 250) comprise a movable element (152; 252) associated with said main body (140) and a seat (124; 224) associated with said first portion (120); and wherein said first connection means (150; 250) comprise bayonet connection means or screw-in connection means.

2. The device (10; 110; 210) according to claim 1, wherein said main body (40; 140) comprises a first opening (42) suited to receive said first portion (20; 120) and/or a second opening (44; 144) suited to receive said second portion (30; 130).

3. The device (10; 110; 210) according to claim 1, wherein said first connection means (50; 150; 250) comprise at least one said seat (24; 124; 224) associated with said first portion (20; 120) and said movable element (52; 152) associated with said main body (40; 140), said movable element (52; 152) comprising a holding element (56; 156) suited to engage said at least one seat (24; 124; 224) of said first portion (20; 120) in said engaged operating configuration or said first connection means comprise at least one holding element associated with said first portion and said movable element associated with said main body, said movable element comprising at least one said seat suited to engage said holding element of said first portion in said engaged operating configuration.

4. The device (10; 110; 210) according to claim 3, wherein said movable element (52; 152) of said first connection means (50; 150; 250) and said second portion (30 130) comprise respective interference surfaces (55, 35; 210) which are designed to interfere in such a way that said first connection means (50; 150, 250) are locked when said main body (40; 140) and said second portion (30; 130) are placed in said engaged operating configuration.

5. The device (10; 110; 210) according to claim 3, wherein said first and/or said second connection means (50, 60; 150, 160; 250, 160) comprise elastic means (58, 68A, 68B; 158, 168A, 168B) suited to push and/or maintain said movable element (52, 62A, 62B; 152, 162A, 162B) towards said engaged operating configuration.

6. The device (10; 110; 210) according to claim 5, wherein said elastic means (58, 68A, 68B; 158, 168A, 168B) comprise at least one helical spring.

7. The device (10; 110; 210) according to claim 1, wherein said second connection means (60; 160) comprise at least one holding seat (34A, 34B; 134A, 134B) associated with said second portion (30; 130) and a movable element (62A, 62B; 162A, 162B) associated with said main body (40; 140), said movable element (62A, 62B; 162A, 162B) comprising a holding element suited to engage said at least one holding seat (34A, 34B; 134A, 134B) of said second portion (30; 130) in said engaged operating configuration or said second connection means comprise at least one holding element associated with said second portion and a movable element associated with said main body, said movable element comprising at least one seat suited to engage said holding element of said second portion in said engaged operating configuration.

8. The device (110; 210) according to claim 1, further comprising said movable element (152) suited to lock said first portion (120) when said main body (140) and said second portion (130) are placed in said engaged operating configuration.

9. A jewellery and/or costume jewellery item (B) comprising a first free end (B1) and a second free end (B2) to be joined through said device (10; 110; 210), wherein said device (10; 110; 210) comprises the fastening and/or the connection device (10; 110; 210) according to claim 1.

10. An ornamental jewellery and/or costume jewellery item comprising said item (B) having a first free end (B1) and a second free end (B2), and said ornamental item comprising said device (10; 110; 210) suited to join said free ends (B1, B2) of said item (B), wherein said device (10; 110; 210) comprises the fastening and/or the connection device (10; 110; 210) according to claim 1.

11. A fastening and/or connection device (10; 110, 210) for a jewellery and/or costume jewellery item (B), said item (B) comprising a first free end (B1) and a second free end (B2) to be joined, said device (10; 110; 210) comprising a first portion (20; 120) suited to be connected to said first free end (B1) of said item (B) and a second portion (30; 130) suited to be connected to said second free end (B2) of said item (B), wherein said device (10; 110; 210) comprises:

a main body (40; 140) suited to be interposed between said first portion (20; 120) and said second portion (30; 130);

first connection means (50; 150; 250) suited to place said main body (40; 140) and said first portion (20; 120) in a disengaged operating configuration or in an engaged operating configuration;

second connection means (60; 160) suited to place said main body (40; 140) and said second portion (30; 130) in a disengaged operating configuration or in an engaged operating configuration;

wherein, in order to join said free ends (B1, B2) of said item (B), said first connection means (50; 150; 250) and said second connection means (60; 160) interact in such a way that said main body (40; 140) and said second portion (30; 130) are placed in said engaged operating configuration through said second connection means (60; 160) only once, said main body (40; 140) and said first portion (20; 120) have been placed in said engaged operating configuration through said first connection means (50; 150; 250);

wherein, in order to separate said free ends (B1, B2) of said item (B), said first connection means (50; 150; 250) and said second connection means (60; 160) interact in such a way that said main body (40; 140) and said first portion (20; 120) are placed in said disengaged operating configuration through said first connection means (50; 150; 250) only once, said main body (40; 140) and said second portion (30; 130) have been placed in said disengaged operating configuration by said second connection means (60; 160);

wherein said first connection means (50; 150; 250) comprise at least one holding seat (24; 124; 224) associated with said first portion (20; 120) and a movable element (52; 152) associated with said main body (40; 140), said movable element (52; 152) comprising a holding element (56; 156) suited to engage said at least one holding seat (24; 124; 224) of said first portion (20; 120) in said engaged operating configuration or said first connection means comprise at least one holding element associated with said first portion and a movable element associated with said main body, said movable element comprising at least one seat suited to engage said holding element of said first portion in said engaged operating configuration; and wherein said movable element (52; 152) of said first connection means (50; 150; 250) and said second portion (30 130) comprise respective interference surfaces (55, 35; 210) which are designed to interfere in such a way that said first connection means (50; 150, 250) are locked when said main body (40; 140) and said second portion (30; 130) are placed in said engaged operating configuration.

12. The device (110; 210) according to claim 11, wherein said first connection means (150; 250) comprise a projecting element (152; 252) associated with said main body (140) and said at least one holding seat (124; 224) associated with said first portion (120).

13. The device (110; 210) according to claim 12, wherein said first connection means (150; 250) comprise bayonet connection means or screw-in connection means.

* * * * *